US009303904B2

(12) United States Patent
Yamashita et al.

(10) Patent No.: US 9,303,904 B2
(45) Date of Patent: Apr. 5, 2016

(54) AIR-CONDITIONING APPARATUS

(75) Inventors: Koji Yamashita, Tokyo (JP); Hiroyuki Morimoto, Tokyo (JP); Takeshi Hatomura, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 997 days.

(21) Appl. No.: 13/504,023

(22) PCT Filed: Oct. 28, 2009

(86) PCT No.: PCT/JP2009/068483

§ 371 (c)(1),
(2), (4) Date: Apr. 25, 2012

(87) PCT Pub. No.: WO2011/052049

PCT Pub. Date: May 5, 2011

(65) Prior Publication Data

US 2012/0204585 A1 Aug. 16, 2012

(51) Int. Cl.
*F25B 25/00* (2006.01)
*F25B 13/00* (2006.01)
(Continued)

(52) U.S. Cl.
CPC ..... *F25B 25/005* (2013.01); *F25B 13/00* (2013.01); *F25B 5/04* (2013.01); *F25B 7/00* (2013.01); *F25B 2313/006* (2013.01); *F25B 2313/0231* (2013.01); *F25B 2313/02741* (2013.01)

(58) Field of Classification Search
CPC ..... F25B 13/00; F25B 7/00; F25B 25/00; F25B 30/02; F25B 30/00
USPC ..... 62/159, 175, 185, 180
See application file for complete search history.

(56) References Cited

U.S. PATENT DOCUMENTS 2,202,946 A * 6/1940 Carrier ..... 165/299
2,279,657 A * 4/1942 Crawford ..... 62/157
(Continued)

FOREIGN PATENT DOCUMENTS

JP 5-280818 A 10/1993
JP 2001-289465 A 10/2001
(Continued)

OTHER PUBLICATIONS

International Search Report (PCT/ISA/210) issued on Jan. 26, 2010, by Japanese Patent Office as the International Searching Authority for International Application No. PCT/JP2009/068483.
(Continued)

*Primary Examiner* — Ljiljana Ciric
*Assistant Examiner* — Alexis Cox
(74) *Attorney, Agent, or Firm* — Buchanan Ingersoll & Rooney PC

(57) ABSTRACT

An air-conditioning apparatus including a bypass pipe that branches off from a portion of a refrigerant pipe located at the refrigerant inlet side of a plurality of heat medium heat exchangers. The bypass pipe connects the refrigerant inlet side with a refrigerant outlet side of each of the plurality of heat medium heat exchangers in the cooling only operation mode. A flow switching device, disposed in the refrigerant pipe, on the outlet side of each of the plurality of heat medium heat exchangers and another flow switching device, disposed in the bypass pipe, on the refrigerant outlet side of each of the plurality of heat medium heat exchangers, cause refrigerant to flow in the bypass pipe in the cooling only operation mode.

6 Claims, 7 Drawing Sheets

(51) Int. Cl.
*F25B 7/00* (2006.01)
*F25B 5/04* (2006.01)

(56) References Cited

U.S. PATENT DOCUMENTS

| | | | | | |
|---|---|---|---|---|---|
| 2,315,379 | A | * | 3/1943 | Robson | 62/95 |
| 2,490,983 | A | * | 12/1949 | Smith et al. | 62/185 |
| 2,797,068 | A | * | 6/1957 | McFarlan | 165/207 |
| 3,520,146 | A | * | 7/1970 | Arnold, Sr. | 62/115 |
| 3,527,059 | A | * | 9/1970 | Rust et al. | 62/115 |
| 3,670,806 | A | * | 6/1972 | McFarlan | 165/210 |
| 4,210,957 | A | * | 7/1980 | Spethmann | 700/276 |
| 4,393,662 | A | * | 7/1983 | Dirth | 62/115 |
| 4,463,574 | A | * | 8/1984 | Spethmann et al. | 62/175 |
| 4,817,395 | A | * | 4/1989 | Martinez, Jr. | 62/175 |
| 6,298,683 | B1 | * | 10/2001 | Kondo et al. | 62/335 |
| 6,393,858 | B1 | * | 5/2002 | Mezaki et al. | 62/335 |
| 2006/0032623 | A1 | * | 2/2006 | Tsubone et al. | 165/202 |
| 2009/0145151 | A1 | | 6/2009 | Wakamoto et al. | |

FOREIGN PATENT DOCUMENTS

| | | | | |
|---|---|---|---|---|
| JP | 2003-343936 | A | | 12/2003 |
| JP | 2004-226015 | A | | 8/2004 |
| JP | 2005-140444 | A | | 6/2005 |
| WO | WO 9420800 | A1 | * | 9/1994 |
| WO | WO 2006/057141 | A1 | | 6/2006 |
| WO | WO 2009100501 | A1 | * | 8/2009 |

OTHER PUBLICATIONS

Chinese Office Action (First Office Action) dated Nov. 25, 2013 issued in corresponding Chinese Patent Application No. 200980162214.6, and an English Translation thereof. (8 pgs.).

* cited by examiner (a) CASE WITHOUT CONSIDERATION OF PRESSURE LOSS IN EVAPORATOR (b) CASE IN CONSIDERATION OF PRESSURE LOSS IN EVAPORATOR

AIR-CONDITIONING APPARATUS

TECHNICAL FIELD

The present invention relates to an air-conditioning apparatus applied to, for example, a multi-air-conditioning apparatus for a building.

BACKGROUND ART

In an air-conditioning apparatus such as a multi-air-conditioning apparatus for a building, a refrigerant is circulated between an outdoor unit, which is a heat source unit disposed, for example, outside a building, and indoor units disposed in rooms in the building. The refrigerant transfers heat or removes heat to heat or cool air, thus heating or cooling a conditioned space through the heated or cooled air. Hydrofluorocarbon (HFC) refrigerants are often used as the refrigerant, for example. Air-conditioning apparatuses that use natural refrigerants as the refrigerant, such as carbon dioxide ($CO_2$), have also been proposed.

In an air-conditioning apparatus called a chiller, a heat source unit disposed outside a building generates cooling energy or heating energy. Water, antifreeze, or the like is heated or cooled by a heat exchanger disposed in an outdoor unit and it is carried to an indoor unit, such as a fan coil unit or a panel heater, to perform heating or cooling (refer to Patent Literature 1, for example).

With another type of air-conditioning apparatus, called an exhaust-heat recovery chiller, four water pipes are connected between the heat source unit and the indoor unit, and cooled water and heated water, for example, are simultaneously supplied so that either cooling or heating can be freely selected by the indoor unit (see Patent Literature 2, for example).

Another type of air-conditioning apparatus is structured so that a heat exchanger for a primary refrigerant and a secondary refrigerant is disposed near each indoor unit, and the secondary refrigerant is carried to the indoor unit (see Patent Literature 3, for example).

Another type of air-conditioning apparatus is structured so that the outdoor unit and a branch unit having heat exchangers are connected with two pipes so that the secondary refrigerant is carried to the indoor unit (see Patent Literature 4, for example).

CITATION LIST

Patent Literature

Patent Literature 1: Japanese Unexamined Patent Application Publication No. 2005-140444 (page 4, FIG. 1, etc.)

Patent Literature 2: Japanese Unexamined Patent Application Publication No. 5-280818 (pages 4 and 5, FIG. 1, etc.)

Patent Literature 3: Japanese Unexamined Patent Application Publication No. 2001-289465 (pages 5 to 8, FIG. 1, FIG. 2, etc.)

Patent Literature 4: Japanese Unexamined Patent Application Publication No. 2003-343936 (page 5, FIG. 1)

SUMMARY OF INVENTION

Technical Problem

A conventional multi-air-conditioning apparatus for a building circulates a refrigerant to indoor units, so there has been the possibility that the refrigerant may leak into a room or other places. With the air-conditioning apparatuses as described in Patent Literatures 1 and 2, the refrigerant does not pass through the indoor unit. However, the air-conditioning apparatuses as described in Patent Literatures 1 and 2 need to heat or cool a heat medium in a heat source unit disposed outside a building and to carry the heated or cooled heat medium to the indoor unit side. Accordingly, a circulation path of the heat medium is prolonged. In this case, to carry heat for a predetermined heating or cooling work using the heat medium, the amount of conveyance power, for example, is larger than that of the refrigerant. Therefore, if the circulation path becomes long, the conveyance power becomes very large. This indicates that if an air-conditioning apparatus can control heat medium circulation well, energy can be saved.

In the air-conditioning apparatus disclosed in Patent Literature 2, to enable selection of cooling or heating in each indoor unit, four pipes must be connected from the outdoor unit to a room, impeding workability. With the air-conditioning apparatus described in Patent Literature 3, secondary medium circulating means such as a pump must be provided for each indoor unit, so the air-conditioning apparatus not only becomes an expensive system but also produces large noise, preventing the air-conditioning apparatus from being practical. In addition, since the heat exchanger is placed near each indoor unit, the risk of leakage of the refrigerant into a place near an indoor space cannot be eliminated.

In the air-conditioning apparatus disclosed in Patent Literature 4, a primary refrigerant that has been subjected to heat exchange flows into the same passage as that of the primary refrigerant to be subjected to heat exchange. In the case in which a plurality of indoor units is connected, it is difficult for each indoor unit to exhibit its maximum capacity. Such a configuration wastes energy. Since a total of four pipes, two for cooling and two for heating, are used for connection between the branch unit and extension pipes, the resulting structure of the air-conditioning apparatus is similar to the structure of the system in which the outdoor unit and the branch unit are interconnected with four pipes, resulting in a system with low workability.

The present invention is made to solve the above problems, and a first object thereof is to provide an air-conditioning apparatus capable of achieving energy saving. In addition to the first object, in some aspects of the present invention, a second object is to provide an air-conditioning apparatus capable of increasing safety without circulating a refrigerant in or near an indoor unit. In addition to the first object and second object, in some aspects of the present invention, a third object is to provide an air-conditioning apparatus capable of reducing the connection pipes between an outdoor unit and a branch unit (heat medium relay unit) or between the branch unit and an indoor unit, and facilitate ease of construction and improve energy efficiency.

Solution to Problem

An air-conditioning apparatus according to the present invention includes at least a compressor, a first refrigerant flow switching device, a heat source side heat exchanger, a plurality of expansion devices, a plurality of heat exchangers related to heat medium, a second refrigerant flow switching device, a third refrigerant flow switching device, a pump, and a use side heat exchanger, in which a refrigerant cycle circulating a heat source side refrigerant is formed by connecting the compressor, the first refrigerant flow switching device, the heat source side heat exchanger, the expansion devices, a refrigerant side passage of each of the heat exchangers related to heat medium, the second refrigerant flow switching device, and the third refrigerant flow switching device with a refrigerant pipe, a heat medium cycle circulating a heat medium is formed by connecting the pump, the use side heat exchanger, and a heat source side passage of each of the heat exchangers related to heat medium with a heat medium pipe, the compressor, the first refrigerant flow switching device, and the heat source side heat exchanger is housed in an outdoor unit, the expansion devices, the heat exchangers related to heat medium, the second refrigerant flow switching device, the third refrigerant flow switching device, and the pump are housed in a heat medium relay unit, the use side heat exchanger is housed in an indoor unit, and the heat source side refrigerant and the heat medium exchange heat with each other in the heat exchangers related to heat medium. The air-conditioning apparatus further includes a bypass pipe, which is housed in the heat medium relay unit, bypassing before and after the heat exchangers related to heat medium and before and after the expansion devices, in which in response to a switching state of the first refrigerant flow switching device, a pressure state of the heat source side refrigerant in the bypass pipe is switched between high pressure and low pressure by the second refrigerant flow switching device and the third refrigerant flow switching device.

Advantageous Effects of Invention

In the air-conditioning apparatus according to the invention, the system start reliably and promptly, and thus energy saving can be achieved.

DESCRIPTION OF EMBODIMENTS

Embodiment of the invention will be described below with reference to the drawings.

Figure 1:
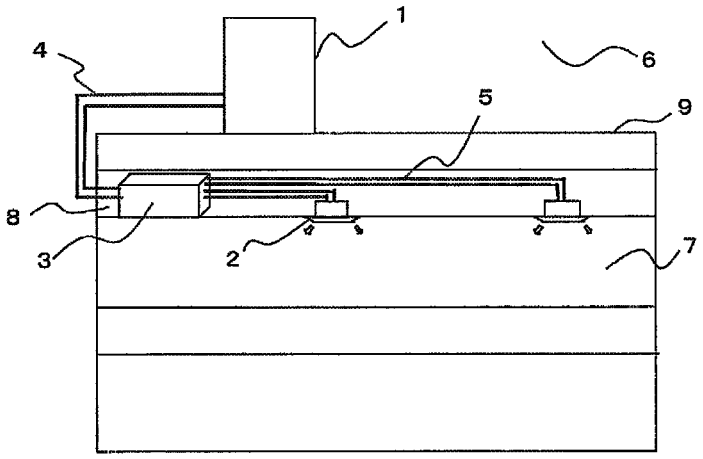
FIG. 1 is a schematic diagram illustrating an exemplary installation of an air-conditioning apparatus according to Embodiment of the invention.

FIG. 1 is a schematic diagram illustrating an exemplary installation of an air-conditioning apparatus according to Embodiment of the invention. The exemplary installation of the air-conditioning apparatus will be described with reference to FIG. 1. This air-conditioning apparatus allows each indoor unit to select the cooling mode or heating mode as its operation mode freely using a refrigeration cycle (refrigerant cycle A, heat medium cycle B) that circulates a refrigerant (heat source side refrigerant, heat medium). It should be noted that the dimensional relationships of components in FIG. 1 and other subsequent figures may be different from the actual ones.

In FIG. 1, the air-conditioning apparatus according to Embodiment includes a single outdoor unit 1 that is a heat source unit, a plurality of indoor units 2, and a heat medium relay unit 3 disposed between the outdoor unit 1 and the indoor units 2. The heat medium relay unit 3 exchanges heat between the heat source side refrigerant and the heat medium. The outdoor unit 1 and the heat medium relay unit 3 are interconnected with refrigerant pipes 4 allowing the heat source side refrigerant to pass therethrough. The heat medium relay unit 3 and each of the indoor units 2 are interconnected with pipes (heat medium pipes) 5 allowing the heat medium to pass therethrough. Cooling energy or heating energy generated by the outdoor unit 1 is delivered to the indoor units 2 through the heat medium relay unit 3.

The outdoor unit 1, typically disposed in an outdoor space 6 which is a space (e.g., a roof) outside a structure 9, such as a building, is configured to supply cooling energy or heating energy through the heat medium relay unit 3 to the indoor units 2. Each indoor unit 2 is disposed at a position such that it can supply cooling air or heating air to an indoor space 7 which is a space (e.g., a living room) in the structure 9 and is configured to supply the cooling air or heating air to the indoor space 7, that is, to a conditioned space. The heat medium relay unit 3 is configured with a housing separate from the outdoor unit 1 and the indoor units 2 such that the heat medium relay unit 3 can be disposed at a position different from those of the outdoor space 6 and the indoor space 7, and is connected to the outdoor unit 1 through the refrigerant pipes 4 and is connected to the indoor units 2 through the pipes 5 to convey cooling energy or heating energy, supplied from the outdoor unit 1, to the indoor units 2.

As illustrated in FIG. 1, in the air-conditioning apparatus according to Embodiment, the outdoor unit 1 is connected to the heat medium relay unit 3 using two refrigerant pipes 4, and the heat medium relay unit 3 is connected to each indoor unit 2 using two pipes 5. As described above, in the air-conditioning apparatus according to Embodiment, each of the units (the outdoor unit 1, the indoor units 2, and the heat medium relay unit 3) is connected using two pipes (the refrigerant pipes 4 or the pipes 5), thus facilitating construction.

Furthermore, FIG. 1 illustrates a state where each heat medium relay unit 3 is disposed in a space different from the indoor space 7, for example, a space above a ceiling (hereinafter, simply referred to as a "space 8") inside the structure 9. The heat medium relay unit 3 can be placed in other spaces, e.g., a common space where an elevator or the like is installed. In addition, although FIG. 1 illustrates a case in which the indoor units 2 are of a ceiling-mounted cassette type, the indoor units are not limited to this type and, for example, a ceiling-concealed type, a ceiling-suspended type, or any type of indoor unit may be used as long as the unit can blow out heating air or cooling air into the indoor space 7 directly or through a duct or the like.

FIG. 1 illustrates the case in which the outdoor unit 1 is disposed in the outdoor space 6. The arrangement is not limited to this case. For example, the outdoor unit 1 may be disposed in an enclosed space, such as a machine room with a vent. The outdoor unit 1 may also be disposed inside the structure 9 as long as it can exhaust waste heat to outside the structure 9 using an exhaust duct. Alternatively, when a water-cooled unit is used as the outdoor unit 1, it may be disposed inside the structure 9. Even when the outdoor unit 1 is disposed in such a place, no problem in particular will occur.

The heat medium relay unit 3 can also be disposed in the vicinity of the outdoor unit 1. It should be noted that when the distance from the heat medium relay unit 3 to the indoor unit 2 is excessively long, because power for conveying the heat medium is significantly large, the advantageous effect of energy saving is reduced. Additionally, the numbers of connected outdoor units 1, indoor units 2, and heat medium relay units 3 are not limited to those illustrated in FIG. 1. The numbers thereof can be determined in accordance with the structure 9 where the air-conditioning apparatus according to Embodiment is installed.

Figure 2:
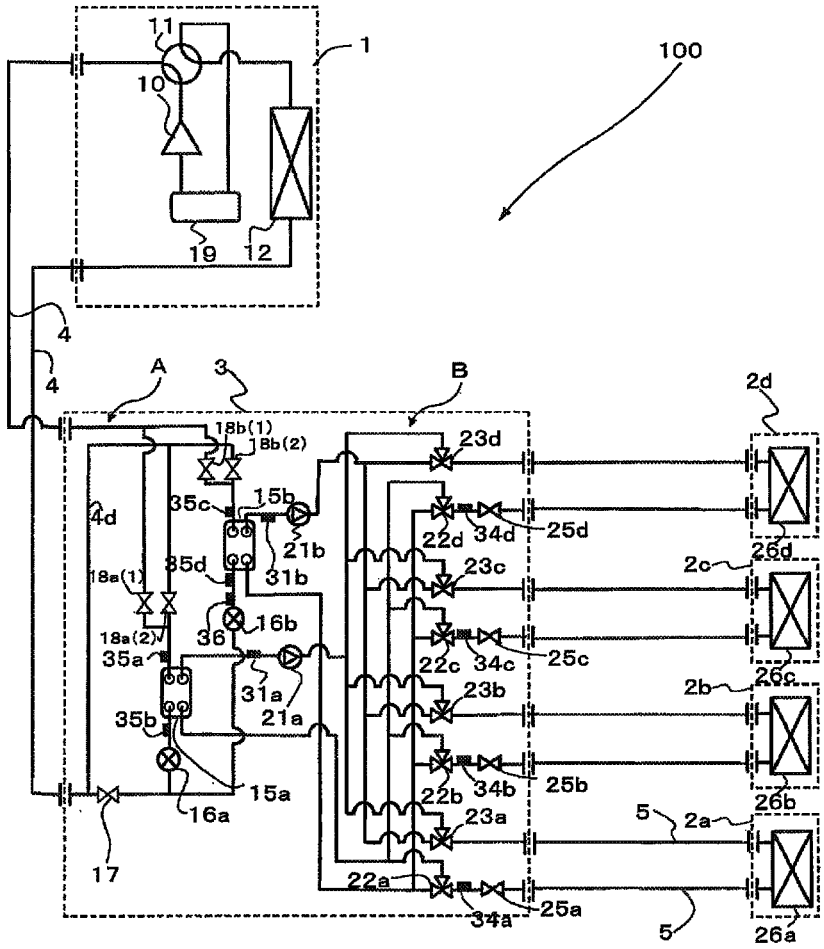
FIG. 2 is a schematic configuration diagram illustrating a configuration of the air-conditioning apparatus according to Embodiment of the invention.

FIG. 2 is a schematic configuration diagram that illustrates an example of the circuit structure of the air-conditioning apparatus according to Embodiment (hereinafter referred to as air-conditioning apparatus 100). The structure of the air-conditioning apparatus 100 is described in detail with reference to FIG. 2. As illustrated in FIG. 2, the outdoor unit 1 and the heat medium relay unit 3 are interconnected with the refrigerant pipes 4 through heat exchangers related to heat medium 15*a* and 15*b* included in the heat medium relay unit 3. The heat medium relay unit 3 and the indoor unit 2 are also interconnected with the pipes 5 through the heat exchangers related to heat medium 15*a* and 15*b*. The refrigerant pipes 4 are described below in detail.

[Outdoor Unit 1]

The outdoor unit 1 includes a compressor 10, a first refrigerant flow switching device 11, such as a four-way valve, a heat source side heat exchanger 12, and an accumulator 19 connected in series with the refrigerant pipes 4.

The compressor 10 sucks the heat source side refrigerant and compresses the heat source side refrigerant to a high-temperature and high-pressure state. An inverter compressor whose capacity is controllable may be used as the compressor 10, for example. The first refrigerant flow switching device 11 switches the flow of the heat source side refrigerant between heating operations (heating only operation mode and heating main operation mode) and cooling operations (cooling only operation mode and cooling main operation mode). The heat source side heat exchanger 12 functions as an evaporator in heating operation, functions as a condenser (or radiator) in cooling operation, exchanges heat between air supplied from a blower (not illustrated), such as a fan, and the heat source side refrigerant, and evaporates and gasifies or condenses and liquefies the heat source side refrigerant. The accumulator 19 is provided on the suction side of the compressor 10 and stores excess refrigerant.

[Indoor Unit 2]

Each of the indoor units 2 includes a use side heat exchanger 26. The use side heat exchanger 26 is connected to a heat medium flow control device 25 and a second heat medium flow switching device 23 in the heat medium relay unit 3 with the pipes 5. The use side heat exchanger 26 exchanges heat between air supplied from a blower (not illustrated), for example a fan, and the heat medium to produce heating air or cooling air that is to be supplied to the indoor space 7.

FIG. 2 illustrates, as an example, in which four indoor units 2 are connected to the heat medium relay unit 3. The four indoor units 2 are illustrated, from the bottom of the drawing, as an indoor unit 2*a*, an indoor unit 2*b*, an indoor unit 2*c*, and an indoor unit 2*d*. In addition, the use side heat exchangers 26 are illustrated as, from the bottom of the drawing, a use side heat exchanger 26*a*, a use side heat exchanger 26*b*, a use side heat exchanger 26*c*, and a use side heat exchanger 26*d* each corresponding to the indoor units 2*a* to 2*d*. As is the case of FIG. 1, the number of connected indoor units 2 illustrated in FIG. 2 is not limited to four.

[Heat Medium Relay Unit 3]

The heat medium relay unit 3 includes two heat exchangers related to heat medium 15, two expansion devices 16, a single on-off device 17, four second refrigerant flow switching devices 18, two pumps 21, four first heat medium flow switching devices 22, four second heat medium flow switching devices 23, and four heat medium flow control devices 25.

Each of the two heat exchangers related to heat medium 15 (the heat exchanger related to heat medium 15*a* and the heat exchanger related to heat medium 15*b*) is configured to function as a condenser (radiator) or an evaporator and exchange heat between the heat source side refrigerant and the heat medium in order to transfer cooling energy or heating energy, produced by the outdoor unit 1 and stored in the heat source side refrigerant, to the heat medium. The heat exchanger related to heat medium 15*a* is disposed between an expansion device 16*a* and second refrigerant flow switching devices 18*a*(1) and 18*a*(2) in a refrigerant cycle A and is used for cooling the heat medium in a cooling and heating mixed operation mode. The heat exchanger related to heat medium 15*b* is disposed between an expansion device 16*b* and second refrigerant flow switching devices 18*b*(1) and 18*b*(2) in the refrigerant cycle A and is used for heating the heat medium in the cooling and heating mixed operation mode.

The two expansion devices 16 (expansion device 16*a*, expansion device 16*b*) function as pressure reducing valves and expansion valves and reduce the pressure of and expand the heat source side refrigerant. The expansion device 16*a* is disposed upstream of the heat exchanger related to heat medium 15*a*, upstream regarding the heat source side refrigerant flow during the cooling operation. The expansion device 16*b* is disposed upstream of the heat exchanger related to heat medium 15*b*, upstream regarding the heat source side refrigerant flow during the cooling operation. Each of the two expansion devices 16 may include a component having a variably controllable opening degree, e.g., an electronic expansion valve.

A two-way valve or the like is used as the on-off device 17 (third refrigerant flow switching device). The on-off device 17 opens and closes the refrigerant pipe 4. The on-off device 17 is disposed in the refrigerant pipe 4 on the inlet side through which the heat source side refrigerant passes (inlet side regarding the heat source side refrigerant flow during the cooling operation).

A two-way valve or the like is used as each of the four second refrigerant flow switching devices 18 (second refrigerant flow switching device 18*a*(1), second refrigerant flow switching device 18*a*(2), second refrigerant flow switching device 18*b*(1), second refrigerant flow switching device 18*b*(2)). The second refrigerant flow switching devices 18 switch the flow directions of the heat source side refrigerant in accordance with the operation mode. The second refrigerant flow switching device 18*a*(1) and the second refrigerant flow switching device 18*a*(2) (hereinafter referred to as second refrigerant flow switching device 18A) are disposed downstream of the heat exchanger related to heat medium 15*a*, downstream regarding the heat source side refrigerant flow during the cooling operation. The second refrigerant flow switching device 18*b*(1) and the second refrigerant flow switching device 18*b*(2) (hereinafter referred to as second refrigerant flow switching device 18B) are disposed downstream of the heat exchanger related to heat medium 15*b*, downstream regarding the heat source side refrigerant flow during the cooling only operation.

The two pumps 21 (pump 21*a*, pump 21*b*) circulate the heat medium passing through the pipe 5. The pump 21*a* is disposed in the pipe 5 between the heat exchanger related to heat medium 15*a* and the second heat medium flow switching devices 23. The pump 21*b* is disposed in the pipe 5 between the heat exchanger related to heat medium 15*b* and the second heat medium flow switching devices 23. Each of the two pumps 21 may include, for example, a capacity-controllable pump.

A three-way valve or the like is used as each of the four first heat medium flow switching devices 22 (first heat medium flow switching device 22*a* to first heat medium flow switching device 22*d*). Each first heat medium flow switching device 22 switches the flow direction of the heat medium. The second heat medium flow switching devices 22 are arranged so that the number thereof (four in this case) corresponds to the installed number of indoor units 1. Each of the first heat medium flow switching devices 22 has three ports: a first one connected to the heat exchanger related to heat medium 15*a*, a second one connected to the heat exchanger related to heat medium 15*b*, and a third one connected to the heat medium flow control device 25. Each first heat medium flow switching device 22 is disposed on the outlet side of the heat medium passage of the use side heat exchanger 26. Furthermore, illustrated from the bottom of the drawing are the first heat medium flow switching device 22*a*, the first heat medium flow switching device 22*b*, the first heat medium flow switching device 22*c*, and the first heat medium flow switching device 22*d*, so as to correspond to the respective indoor units 2.

A three-way valve or the like is used as each of the four second heat medium flow switching devices 23 (second heat medium flow switching device 23*a* to second heat medium flow switching device 23*d*). Each second heat medium flow switching device 23 switches the flow direction of the heat medium. The second heat medium flow switching devices 23 are arranged so that the number thereof (four in this case) corresponds to the installed number of indoor units 2. Each of the second heat medium flow switching devices 23 has three ports: a first one connected to the heat exchanger related to heat medium 15*a*, a second one connected to the heat exchanger related to heat medium 15*b*, and a third one connected to the use side heat exchanger 26. Each second heat medium flow switching device 23 is disposed on the inlet side of the heat medium passage of the use side heat exchanger 26. Furthermore, illustrated from the bottom of the drawing are the second heat medium flow switching device 23*a*, the second heat medium flow switching device 23*b*, the second heat medium flow switching device 23*c*, and the second heat medium flow switching device 23*d* so as to correspond to the respective indoor units 2.

A two-way valve whose opening area is controllable or the like is used as each of the four heat medium flow control devices 25 (heat medium flow control device 25*a* to heat medium flow control device 25*d*). Each heat medium flow control device 25 controls the flow rate of the heat medium passing through the pipe 5. The heat medium flow controllers 25 are arranged so that the number thereof (four in this case) corresponds to the installed number of indoor units 2. Each of the heat medium flow control devices 25 has two ports: a first one connected to the use side heat exchanger 26 and a second one connected to the first heat medium flow switching device 22. Each heat medium flow control device 25 is disposed on the outlet side of the heat medium passage of the use side heat exchanger 26. Furthermore, illustrated from the bottom of the drawing are the heat medium flow controller 25*a*, the heat medium flow controller 25*b*, the heat medium flow controller 25*c*, and the heat medium flow controller 25*d* so as to correspond to the respective indoor units 2. Furthermore, each heat medium flow control device 25 may be disposed on the inlet side of the passage of the use side heat exchanger 26.

The heat medium relay unit 3 includes various detection means (two first temperature sensors 31, four second temperature sensors 34, four third temperature sensors 35, and a pressure sensor 36). Information (temperature information and pressure information) detected by these detecting means are transmitted to a control device (not illustrated) that performs integrated control of the operation of the air-conditioning apparatus 100 such that the information is used to control, for example, the driving frequency of the compressor 10, the rotation speed of the blower (not illustrated), switching by the first refrigerant flow switching device 11, the driving frequency of the pumps 21, switching by the second refrigerant flow switching devices 18, and switching of passages of the heat medium.

The two first temperature sensors 31 (first temperature sensor 31*a*, first temperature sensor 31*b*) each detects the temperature of the heat medium that has flowed out from the corresponding heat exchanger related to heat medium 15, that is, detects the temperature of the heat medium at the outlet of the corresponding heat exchanger related to heat medium 15. A thermistor or the like may be used as each of the first temperature sensors 31, for example. The first temperature sensor 31*a* is disposed in the pipe 5 on the inlet side of the pump 21*a*. The first temperature sensor 31*b* is disposed in the pipe 5 on the inlet of the pump 21*b*.

Each of the four second temperature sensors 34 (second temperature sensor 34*a* to second temperature sensor 34*d*) is disposed between the first heat medium flow switching device 22 and the heat medium flow control device 25 and detects the temperature of the heat medium flowing out of the use side heat exchanger 26. A thermistor or the like may be used as the second temperature sensor 34. The second temperature sensors 34 are arranged so that the number (four in this case) corresponds to the installed number of indoor units 2. Furthermore, illustrated from the bottom of the drawing are the second temperature sensor 34*a*, the second temperature sensor 34*b*, the second temperature sensor 34*c*, and the second temperature sensor 34*d* so as to correspond to the respective indoor units 2.

Each of the four third temperature sensors 35 (third temperature sensor 35*a* to third temperature sensor 35*d*) is disposed on the inlet or outlet side of the heat exchanger related to heat medium 15 through which the heat source side refrigerant passes and detects the temperature of the heat source side refrigerant flowing into the heat exchanger related to heat medium 15 or the temperature of the heat source side refrigerant flowing out of the heat exchanger related to heat medium 15. A thermistor or the like may be used as the third temperature sensor 35. The third temperature sensor 35*a* is disposed between the heat exchanger related to heat medium 15*a* and the second refrigerant flow switching device 18A. The third temperature sensor 35*b* is disposed between the heat exchanger related to heat medium 15*a* and the expansion device 16*a*. The third temperature sensor 35*c* is disposed between the heat exchanger related to heat medium 15*b* and the second refrigerant flow switching device 18B. The third temperature sensor 35*d* is disposed between the heat exchanger related to heat medium 15*b* and the expansion device 16*b*.

The pressure sensor 36 is disposed between the heat exchanger related to heat medium 15*b* and the expansion device 16*b*, similar to the location of the third temperature sensor 35*d*, and detects the pressure of the heat source side refrigerant flowing between the heat exchanger related to heat medium 15*b* and the expansion device 16*b*.

Further, the control device (not illustrated) includes, for example, a microcomputer and controls, for example, the driving frequency of the compressor 10, the rotation speed (including ON/OFF) of the blower, switching by the first refrigerant flow switching device 11, driving of the pumps 21, the opening degree of each expansion device 16, on and off of each on-off device 17, switching of the second refrigerant flow switching devices 18, switching of the first heat medium flow switching devices 22, switching of the second heat medium flow direction switching devices 23, and the driving of each heat medium flow controller 25 on the basis of the information detected by the various detecting means and an instruction from a remote control to carry out the operation modes which will be described later. Note that the controller may be provided for each unit or may be provided for the outdoor unit 1 or the heat medium relay unit 3.

A bypass pipe 4*d* is connected to the refrigerant pipe 4 before and after the heat exchanger related to heat medium 15 and the expansion device 16 so as to bypass them. Specifically, the bypass pipe 4*d* is disposed so as to connect a point in the pipe between the heat source side heat exchanger 12 and the on-off device 17 to the second refrigerant flow switching device 18*a*(2) and the second refrigerant flow switching device 18*b*(2). In the following description, the refrigerant pipe 4 includes the bypass pipe 4*d* unless otherwise specified.

The pipe 5 allowing the heat medium to pass therethrough includes pipes connected to the heat exchanger related to heat medium 15*a* and pipes connected to the heat exchanger related to heat medium 15*b*. Each pipe 5 is branched (into four in this case) in accordance with the number of indoor units 2 connected to the heat medium relay unit 3. The pipes 5 are connected through the first heat medium flow switching devices 22 and the second heat medium flow switching devices 23. Control of the first heat medium flow switching devices 22 and the second heat medium flow switching devices 23 determines whether the heat medium flowing from the heat exchanger related to heat medium 15*a* flows into the use side heat exchanger 26 and whether the heat medium flowing from the heat exchanger related to heat medium 15*b* flows into the use side heat exchanger 26.

In the air-conditioning apparatus 100, the compressor 10, the first refrigerant flow switching device 11, the heat source side heat exchanger 12, the on-off devices 17, the second refrigerant flow switching devices 18, a refrigerant passage of the heat exchanger related to heat medium 15*a*, the expansion devices 16, and the accumulator 19 are connected through the refrigerant pipes 4, thus forming the refrigerant cycle A. In addition, a heat medium passage of the heat exchanger related to heat medium 15*a*, the pumps 21, the first heat medium flow switching devices 22, the heat medium flow controllers 25, the use side heat exchangers 26, and the second heat medium flow switching devices 23 are connected through the pipes 5, thus forming heat medium cycle B. In other words, the plurality of use side heat exchangers 26 are connected in parallel to each of the heat exchangers related to heat medium 15, thus turning the heat medium cycle B into a multi-system.

Accordingly, in the air-conditioning apparatus 100, the outdoor unit 1 and the heat medium relay unit 3 are connected through the heat exchanger related to heat medium 15*a* and the heat exchanger related to heat medium 15*b* arranged in the heat medium relay unit 3. The heat medium relay unit 3 and each indoor unit 2 are connected through the heat exchanger related to heat medium 15*a* and the heat exchanger related to heat medium 15*b*. In other words, in the air-conditioning apparatus 100, the heat exchanger related to heat medium 15*a* and the heat exchanger related to heat medium 15*b* each exchange heat between the heat source side refrigerant circulating in the refrigerant cycle A and the heat medium circulating in the heat medium cycle B.

Various operation modes executed by the air-conditioning apparatus 100 are described below. The air-conditioning apparatus 100 allows each indoor unit 2, on the basis of an instruction from the indoor unit 2, to perform a cooling operation or heating operation. Specifically, the air-conditioning apparatus 100 allows all of the indoor units 2 to perform the same operation and also allows each of the indoor units 2 to perform different operations.

The operation modes carried out by the air-conditioning apparatus 100 includes a cooling only operation mode in which all of the operating indoor units 2 perform the cooling operation, a heating only operation mode in which all of the operating indoor units 2 perform the heating operation, a cooling main operation mode in which cooling load is larger, and a heating main operation mode in which heating load is larger. The operation modes will be described below with respect to the flow of the heat source side refrigerant and that of the heat medium.

[Cooling Only Operation Mode]

Figure 3:
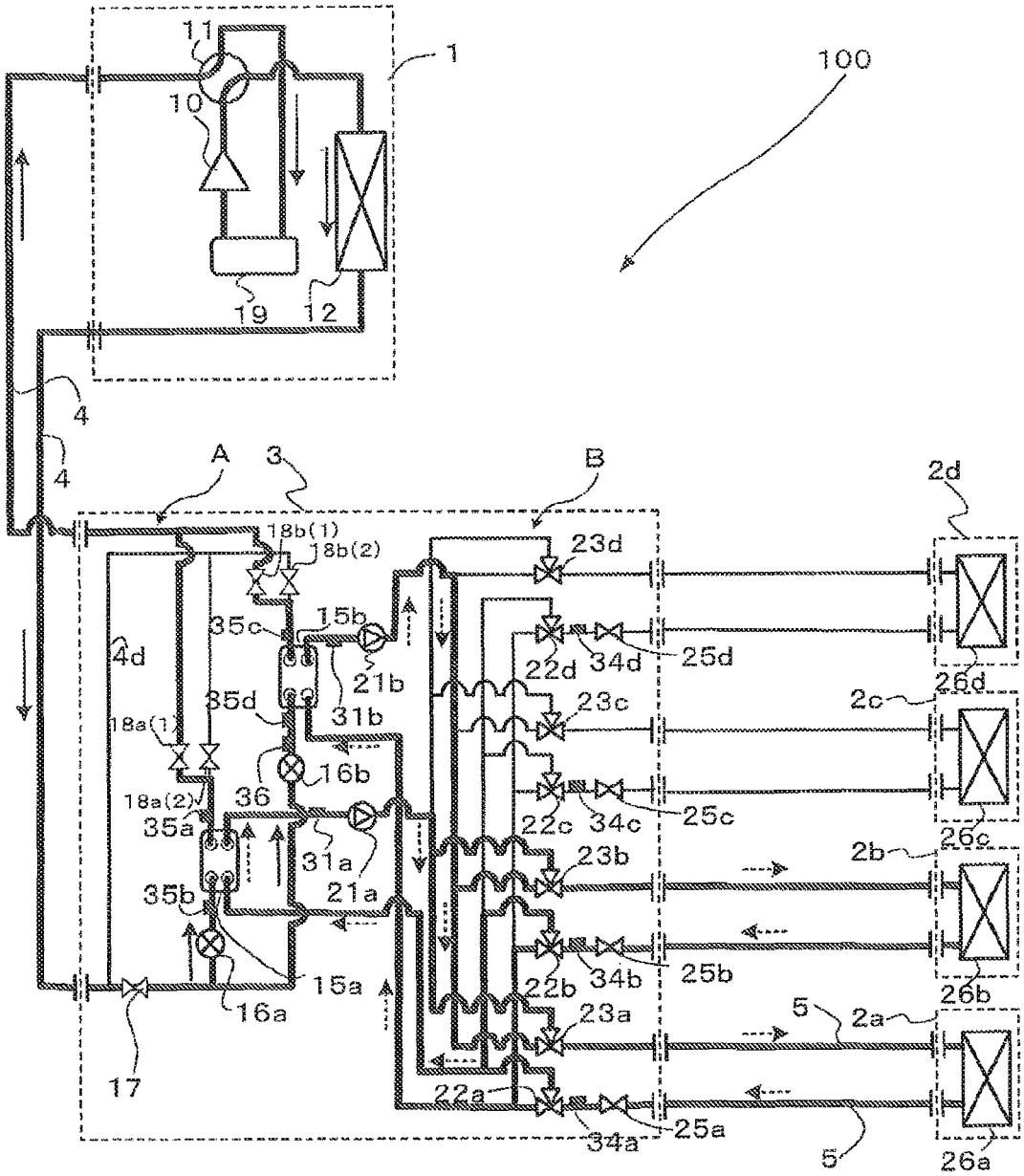
FIG. 3 is a refrigerant circuit diagram illustrating flows of refrigerants in a cooling only operation mode of the air-conditioning apparatus according to Embodiment of the invention.

FIG. 3 is a refrigerant circuit diagram illustrating the flows of refrigerants in the cooling only operation mode of the air-conditioning apparatus 100. The cooling only operation mode will be described with respect to a case in which a cooling energy load is generated only in a use side heat exchanger 26*a* and a use side heat exchanger 26*b* in FIG. 3. Furthermore, in FIG. 3, pipes indicated by thick lines correspond to pipes through which the refrigerants (the heat source side refrigerant and the heat medium) flow. In addition, the direction of flow of the heat source side refrigerant is indicated by solid-line arrows and the direction of flow of the heat medium is indicated by broken-line arrows in FIG. 3.

In the cooling only operation mode illustrated in FIG. 3, in the outdoor unit 1, a first refrigerant flow switching device 11 is switched such that the heat source side refrigerant discharged from a compressor 10 flows into a heat source side heat exchanger 12. In the heat medium relay unit 3, the on-off device 17 is opened, the pump 21*a* and the pump 21*b* are driven, the heat medium flow controller 25*a* and the heat medium flow controller 25*b* are opened, and the heat medium flow controller 25*c* and the heat medium flow controller 25*d* are fully closed such that the heat medium circulates between each of the heat exchanger related to heat medium 15*a* and the heat exchanger related to heat medium 15*b* and each of the use side heat exchanger 26*a* and the use side heat exchanger 26*b*.

First, the flow of the heat source side refrigerant in the refrigerant cycle A will be described.

A low-temperature low-pressure refrigerant is compressed by the compressor 10 and is discharged as a high-temperature high-pressure gas refrigerant therefrom. The high-temperature high-pressure gas refrigerant discharged from the compressor 10 flows through the first refrigerant flow switching device 11 into the heat source side heat exchanger 12. Then, the refrigerant is condensed into a high-pressure liquid refrigerant while transferring heat to outdoor air in the heat source side heat exchanger 12. The high-pressure liquid refrigerant flowing out of the heat source side heat exchanger 12, flows out of the outdoor unit 1, passes through the refrigerant pipe 4, and flows into the heat medium relay unit 3. The high-pressure liquid refrigerant flowing into the heat medium relay unit 3 is branched after passing through an on-off device 17 and is expanded into a low-temperature low-pressure two-phase refrigerant by an expansion device 16*a* and an expansion device 16*b*.

This two-phase refrigerant flows into each of the heat exchanger related to heat medium 15*a* and the heat exchanger related to heat medium 15*b*, functioning as evaporators, removes heat from the heat medium circulating in a heat medium cycle B to cool the heat medium, and thus turns into a low-temperature low-pressure gas refrigerant. The gas refrigerant, which has flowed out of each of the heat exchanger related to heat medium 15*a* and the heat exchanger related to heat medium 15*b*, flows out of the heat medium relay unit 3 through the corresponding one of a second refrigerant flow switching device 18*a*(1) and a second refrigerant flow switching device 18*b*(1), passes through the refrigerant pipe 4, and again flows into the outdoor unit 1.

At this time, the second refrigerant flow switching device 18*a*(1) is opened, the second refrigerant flow switching device 18*a*(2) is closed, the second refrigerant flow switching device 18*b*(1) is opened, and the second refrigerant flow switching device 18*b*(2) is closed. Because both of the second refrigerant flow switching device 18*a*(2) and the second refrigerant flow switching device 18*b*(2) are closed, no refrigerant flows through the bypass pipe 4*d*. However, one end of the bypass pipe 4*d* is a high-pressure liquid tube and the bypass pipe 4*d* is filled with the high-pressure refrigerant. The refrigerant flowing into the outdoor unit 1 passes through the first refrigerant flow switching device 11, and the accumulator 19, and is again sucked into the compressor 10.

At this time, the opening degree of the expansion device 16*a* is controlled such that superheat (the degree of superheat) is constant, the superheat being obtained as the difference between a temperature detected by the third temperature sensor 35*a* and that detected by the third temperature sensor 35*b*. Similarly, the opening degree of the expansion device 16*b* is controlled such that superheat is constant, the superheat being obtained as the difference between a temperature detected by a third temperature sensor 35*c* and that detected by a third temperature sensor 35*d*.

Next, the flow of the heat medium in the heat medium cycle B will be described.

In the cooling only operation mode, both of the heat exchanger related to heat medium 15*a* and the heat exchanger related to heat medium 15*b* transfer cooling energy of the heat source side refrigerant to the heat medium, and the pump 21*a* and the pump 21*b* allow the cooled heat medium to flow through the pipes 5. The heat medium, which has flowed out of each of the pump 21*a* and the pump 21*b* while being pressurized, flows through the corresponding one of the second heat medium flow switching device 23*a* and the second heat medium flow switching device 23*b* into the corresponding one of the use side heat exchanger 26*a* and the use side heat exchanger 26*b*. The heat medium removes heat from the indoor air in each of the use side heat exchanger 26*a* and the use side heat exchanger 26*b*, thus cooling the indoor space 7.

Then, the heat medium flows out of each of the use side heat exchanger 26*a* and the use side heat exchanger 26*b* and flows into the corresponding one of the heat medium flow controller 25*a* and the heat medium flow controller 25*b*. At this time, the function of each of the heat medium flow control device 25*a* and the heat medium flow control device 25*b* allows the heat medium to flow into the corresponding one of the use side heat exchanger 26*a* and the use side heat exchanger 26*b* while controlling the heat medium to a flow rate sufficient to cover an air conditioning load required in the indoor space. The heat medium, which has flowed out of the heat medium flow controller 25*a* and the heat medium flow controller 25*b*, passes through the first heat medium flow switching device 22*a* and the first heat medium flow switching device 22*b*, flows into the heat exchanger related to heat medium 15*a* and the heat exchanger related to heat medium 15*b*, and is again sucked into the pump 21*a* and the pump 21*b*.

Note that in the pipe 5 in each use side heat exchanger 26, the heat medium is directed to flow from the second heat medium flow switching device 23 through the heat medium flow controller 25 to the first heat medium flow switching device 22. The air conditioning load required in the indoor space 7 can be satisfied by controlling the difference between a temperature detected by the first temperature sensor 31*a* or a temperature detected by the first temperature sensor 31*b* and a temperature detected by the second temperature sensor 34 so that difference is maintained at a target value. As regards a temperature at the outlet of each heat exchanger related to heat medium 15, either of the temperature detected by the first temperature sensor 31*a* and that detected by the first temperature sensor 31*b* may be used. Alternatively, the mean temperature of the two may be used. At this time, the opening degree of each of the first heat medium flow switching devices 22 and the second heat medium flow switching devices 23 are set to a medium degree such that passages to both the heat exchanger related to heat medium 15*a* and the heat exchanger related to heat medium 15*b* are established.

Upon carrying out the cooling only operation mode, since it is unnecessary to supply the heat medium to each use side heat exchanger 26 having no heat load (including thermo-off), the passage is closed by the corresponding heat medium flow controller 25 such that the heat medium does not flow into the use side heat exchanger 26. In FIG. 3, the heat medium is supplied to the use side heat exchanger 26*a* and the use side heat exchanger 26*b* because these use side heat exchangers have heat loads. The use side heat exchanger 26*c* and the use side heat exchanger 26*d* have no heat load and the corresponding heat medium flow controllers 25*c* and 25*d* are fully closed. When a heat load is generated in the use side heat exchanger 26*c* or the use side heat exchanger 26*d*, the heat medium flow controller 25*c* or the heat medium flow controller 25*d* may be opened such that the heat medium is circulated.

[Heating Only Operation Mode]

Figure 4:
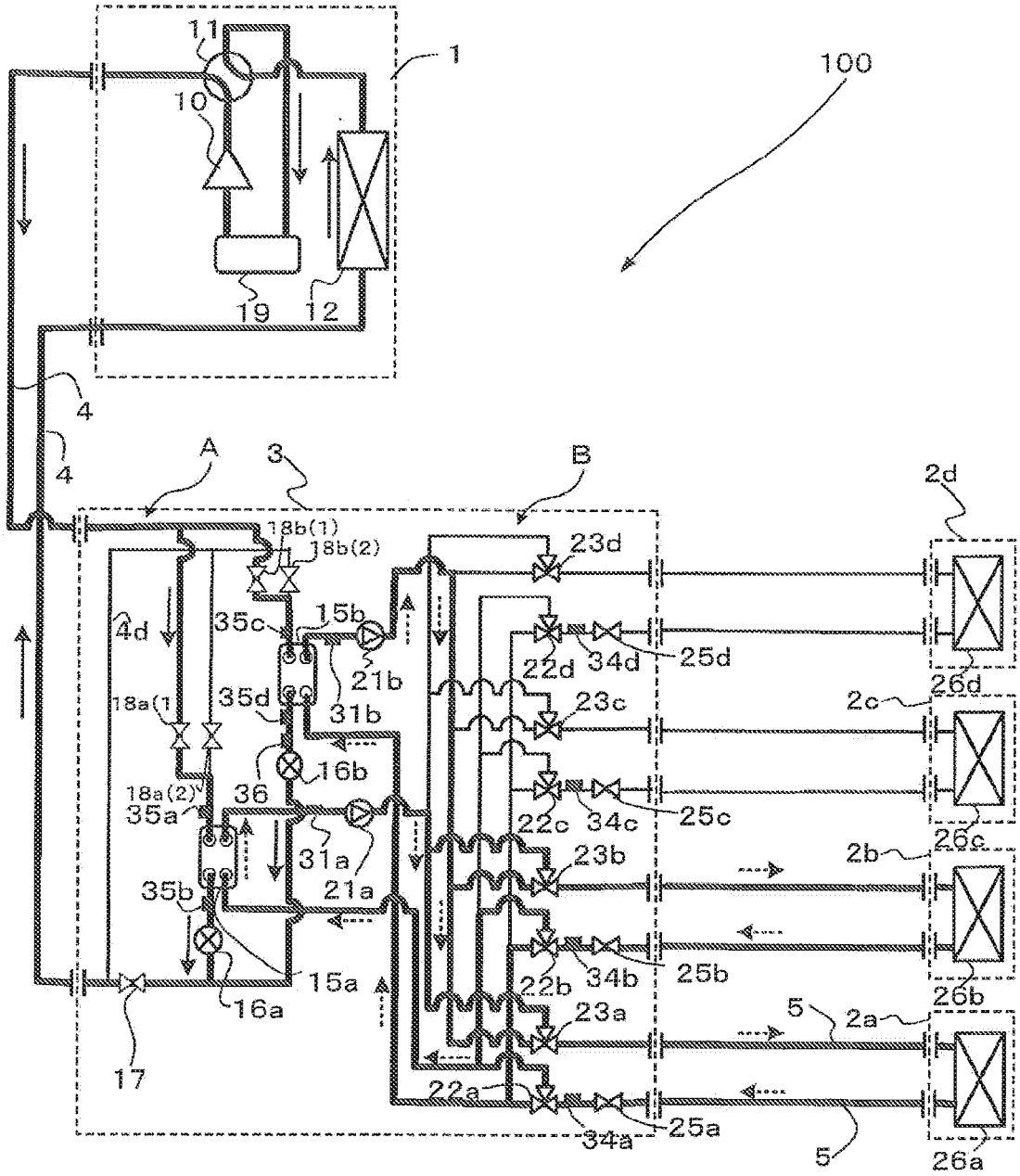
FIG. 4 is a refrigerant circuit diagram illustrating flows of the refrigerants in a heating only operation mode of the air-conditioning apparatus according to Embodiment of the invention.

FIG. 4 is a refrigerant circuit diagram illustrating the flows of the refrigerants in the heating only operation mode of the air-conditioning apparatus 100. The heating only operation mode will be described with respect to a case in which a heating energy load is generated only in the use side heat exchanger 26*a* and the use side heat exchanger 26*b* in FIG. 4. Furthermore, in FIG. 4, pipes indicated by thick lines correspond to pipes through which the refrigerants (the heat source side refrigerant and the heat medium) flow. In addition, the direction of flow of the heat source side refrigerant is indicated by solid-line arrows and the direction of flow of the heat medium is indicated by broken-line arrows in FIG. 4.

In the heating only operation mode illustrated in FIG. 4, in the outdoor unit 1, the first refrigerant flow switching device 11 is switched such that the heat source side refrigerant discharged from the compressor 10 flows into the heat medium relay unit 3 without passing through the heat source side heat exchanger 12. In the heat medium relay unit 3, the on-off device 17 is opened, the pump 21*a* and the pump 21*b* are driven, the heat medium flow controller 25*a* and the heat medium flow controller 25*b* are opened, and the heat medium flow controller 25*c* and the heat medium flow controller 25*d* are fully closed such that the heat medium circulates between each of the heat exchanger related to heat medium 15*a* and the heat exchanger related to heat medium 15*b* and each of the use side heat exchanger 26*a* and the use side heat exchanger 26*b*.

First, the flow of the heat source side refrigerant in the refrigerant cycle A will be described.

A low-temperature low-pressure refrigerant is compressed by the compressor 10 and is discharged as a high-temperature high-pressure gas refrigerant therefrom. The high-temperature high-pressure gas refrigerant discharged from the compressor 10 passes through the first refrigerant flow switching device 11 and flows out of the outdoor unit 1. The high-temperature high-pressure gas refrigerant, which has flowed out of the outdoor unit 1, passes through the refrigerant pipe 4 and flows into the heat medium relay unit 3. The high-temperature and high-pressure gas refrigerant flowing into the heat medium relay unit 3 branches, passes through the second refrigerant flow switching device 18*a*(1) and the second refrigerant flow switching device 18*b*(1), and flows into each of the heat exchanger related to heat medium 15*a* and the heat exchanger related to heat medium 15*b*.

At this time, the second refrigerant flow switching device 18*a*(1) is opened, the second refrigerant flow switching device 18*a*(2) is closed, the second refrigerant flow switching device 18*b*(1) is opened, and the second refrigerant flow switching device 18*b*(2) is closed.

The high-temperature high-pressure gas refrigerant flowing into each of the heat exchanger related to heat medium 15*a* and the heat exchanger related to heat medium 15*b* is condensed into a high-pressure liquid refrigerant while transferring heat to the heat medium circulating in the heat medium cycle B. The liquid refrigerant flowing out of the heat exchanger related to heat medium 15*a* and that flowing out of the heat exchanger related to heat medium 15*b* are expanded into a low-temperature low-pressure, two-phase refrigerant through the expansion device 16*a* and the expansion device 16*b*. This two-phase refrigerant passes through the on-off device 17, flows out of the heat medium relay unit 3, passes through the refrigerant pipe 4, and again flows into the outdoor unit 1. The refrigerant flowing into the outdoor unit 1 flows into the heat source side heat exchanger 12, functioning as an evaporator.

Here, because both the second refrigerant flow switching device 18*a*(2) and the second refrigerant flow switching device 18*b*(2) are closed, no refrigerant flows through the bypass pipe 4*d*. However, one end of the bypass pipe 4*d* is a low-pressure two-phase tube and the bypass pipe 4*d* is filled with the low-pressure refrigerant.

Then, the refrigerant flowing into the heat source side heat exchanger 12 removes heat from the outdoor air in the heat source side heat exchanger 12 and thus turns into a low-temperature low-pressure gas refrigerant. The low-temperature low-pressure gas refrigerant flowing out of the heat source side heat exchanger 12 passes through the first refrigerant flow switching device 11 and the accumulator 19 and is again sucked into the compressor 10.

At that time, the opening degree of the expansion device 16*a* is controlled such that subcooling (degree of subcooling) obtained as the difference between a saturation temperature converted from a pressure detected by the pressure sensor 36 and a temperature detected by the third temperature sensor 35*b* is constant. Similarly, the opening degree of the expansion device 16*b* is controlled such that subcooling is constant, the subcooling being obtained as the difference between the value indicating the saturation temperature calculated from the pressure detected by the pressure sensor 36 and a temperature detected by the third temperature sensor 35*d*. Note that in the case in which a temperature can be measured at the middle position of the heat exchangers related to heat medium 15, the temperature at the middle position may be used instead of the pressure sensor 36. Thus, such a system can be constructed inexpensively.

Next, the flow of the heat medium in the heat medium cycle B will be described.

In the heating only operation mode, both of the heat exchanger related to heat medium 15*a* and the heat exchanger related to heat medium 15*b* transfer heating energy of the heat source side refrigerant to the heat medium, and the pump 21*a* and the pump 21*b* allow the heated heat medium to flow through the pipes 5. The heat medium, which has flowed out of each of the pump 21*a* and the pump 21*b* while being pressurized, flows through the corresponding one of the second heat medium flow switching device 23*a* and the second heat medium flow switching device 23*b* into the corresponding one of the use side heat exchanger 26*a* and the use side heat exchanger 26*b*. The heat medium transfers heat to the indoor air through each of the use side heat exchanger 26*a* and the use side heat exchanger 26*b*, thus heating the indoor space 7.

Then, the heat medium flows out of each of the use side heat exchanger 26*a* and the use side heat exchanger 26*b* and flows into the corresponding one of the heat medium flow controller 25*a* and the heat medium flow controller 25*b*. At this time, the function of each of the heat medium flow control device 25*a* and the heat medium flow control device 25*b* allows the heat medium to flow into the corresponding one of the use side heat exchanger 26*a* and the use side heat exchanger 26*b* while controlling the heat medium to a flow rate sufficient to cover an air conditioning load required in the indoor space. The heat medium, which has flowed out of the heat medium flow controller 25*a* and the heat medium flow controller 25*b*, passes through the first heat medium flow switching device 22*a* and the first heat medium flow switching device 22*b*, flows into the heat exchanger related to heat medium 15*a* and the heat exchanger related to heat medium 15*b*, and is again sucked into the pump 21*a* and the pump 21*b*.

Note that in the pipe 5 in each use side heat exchanger 26, the heat medium is directed to flow from the second heat medium flow switching device 23 through the heat medium flow controller 25 to the first heat medium flow switching device 22. The air conditioning load required in the indoor space 7 can be satisfied by controlling the difference between a temperature detected by the first temperature sensor 31*a* or a temperature detected by the first temperature sensor 31*b* and a temperature detected by the second temperature sensor 34 so that difference is maintained at a target value. As regards a temperature at the outlet of each heat exchanger related to heat medium 15, either of the temperature detected by the first temperature sensor 31*a* and that detected by the first temperature sensor 31*b* may be used. Alternatively, the mean temperature of the two may be used.

At this time, the opening degree of each of the first heat medium flow switching devices 22 and the second heat medium flow switching devices 23 are set to a medium degree such that passages to both the heat exchanger related to heat medium 15*a* and the heat exchanger related to heat medium 15*b* are established. Although the use side heat exchanger 26*a* should essentially be controlled on the basis of the difference between a temperature at the inlet and that at the outlet, since the temperature of the heat medium on the inlet side of the use side heat exchanger 26 is substantially the same as that detected by the first temperature sensor 31*b*, the use of the first temperature sensor 31*b* can reduce the number of temperature sensors, so that the system can be constructed inexpensively.

Upon carrying out the heating only operation mode, since it is unnecessary to supply the heat medium to each use side heat exchanger 26 having no heat load (including thermo-off), the passage is closed by the corresponding heat medium flow controller 25 such that the heat medium does not flow into the use side heat exchanger 26. In FIG. 4, the heat medium is supplied to the use side heat exchanger 26*a* and the use side heat exchanger 26*b* because these use side heat exchangers have heat loads. The use side heat exchanger 26*c* and the use side heat exchanger 26*d* have no heat load and the corresponding heat medium flow controllers 25*c* and 25*d* are fully closed. When a heat load is generated in the use side heat exchanger 26*c* or the use side heat exchanger 26*d*, the heat medium flow controller 25*c* or the heat medium flow controller 25*d* may be opened such that the heat medium is circulated.

[Cooling Main Operation Mode]

Figure 5:
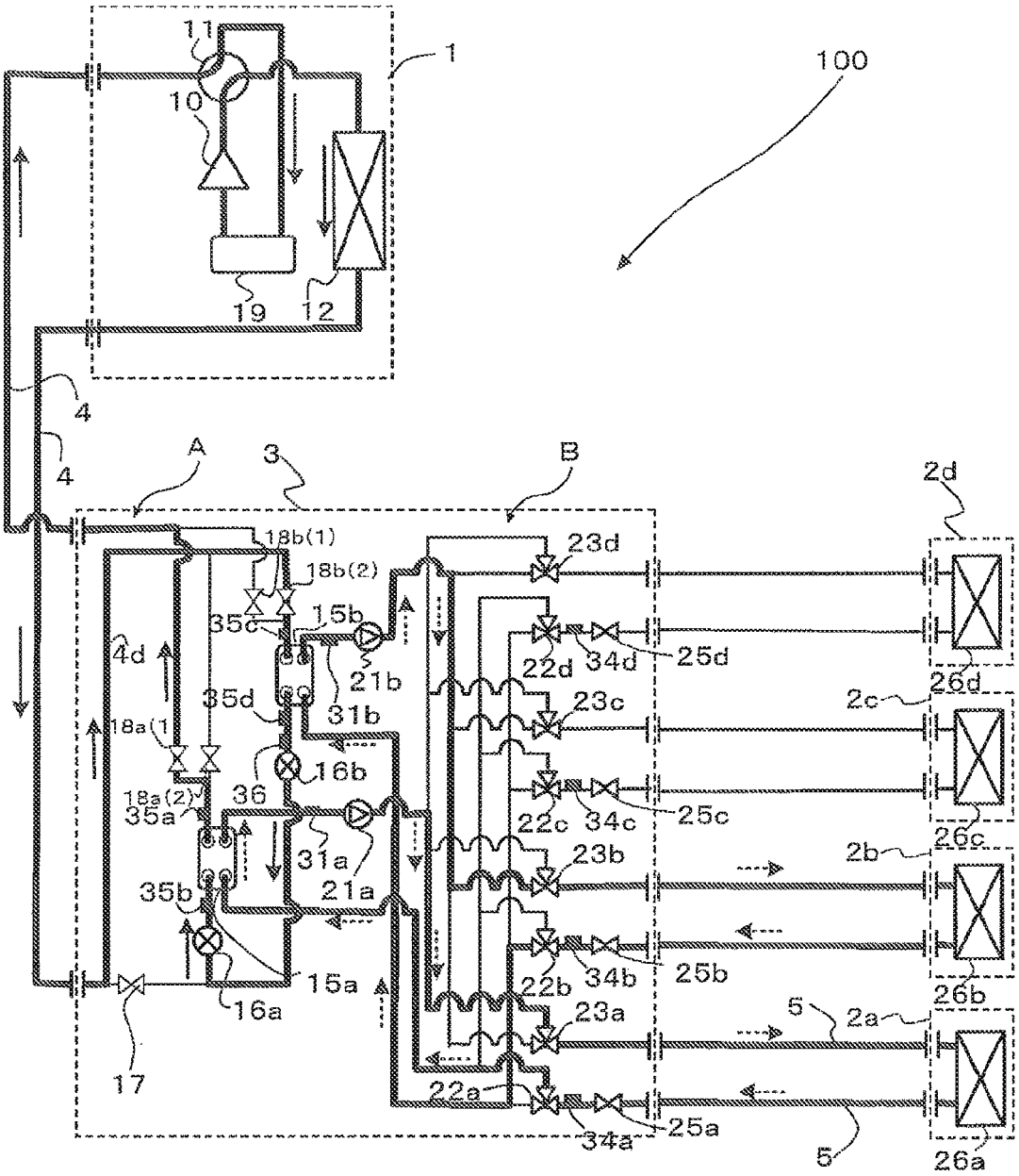
FIG. 5 is a refrigerant circuit diagram illustrating flows of the refrigerants in a cooling main operation mode of the air-conditioning apparatus according to Embodiment of the invention.

FIG. 5 is a refrigerant circuit diagram illustrating the flows of the refrigerants in the cooling main operation mode of the air-conditioning apparatus 100. The cooling main operation mode will be described with respect to a case in which a cooling energy load is generated in the use side heat exchanger 26*a* and a heating energy load is generated in the use side heat exchanger 26*b* in FIG. 5. Furthermore, in FIG. 5, pipes indicated by thick lines correspond to pipes through which the refrigerants (the heat source side refrigerant and the heat medium) circulate. In addition, the direction of flow of the heat source side refrigerant is indicated by solid-line arrows and the direction of flow of the heat medium is indicated by broken-line arrows in FIG. 5.

In the cooling main operation mode illustrated in FIG. 5, in the outdoor unit 1, the first refrigerant flow switching device 11 is switched such that the heat source side refrigerant discharged from the compressor 10 flows into the heat source side heat exchanger 12. In the heat medium relay unit 3, the on-off device is closed, the pump 21*a* and the pump 21*b* are driven, the heat medium flow controller 25*a* and the heat medium flow controller 25*b* are opened, and the heat medium flow controller 25*c* and the heat medium flow controller 25*d* are fully closed such that the heat medium circulates between the heat exchanger related to heat medium 15*a* and the use side heat exchanger 26*a* and the heat medium circulates between the heat exchanger related to heat medium 15*b* and the use side heat exchanger 26*b*.

First, the flow of the heat source side refrigerant in the refrigerant cycle A will be described.

A low-temperature low-pressure refrigerant is compressed by the compressor 10 and is discharged as a high-temperature high-pressure gas refrigerant therefrom. The high-temperature high-pressure gas refrigerant discharged from the compressor 10 flows through the first refrigerant flow switching device 11 into the heat source side heat exchanger 12. The refrigerant is condensed into a two-phase refrigerant in the heat source side heat exchanger 12 while transferring heat to the outside air. The two-phase refrigerant flowing out of the heat source side heat exchanger 12 flows out of the outdoor unit 1, passes through the refrigerant pipe 4, and flows into the heat medium relay unit 3. The two-phase refrigerant flowing into the heat medium relay unit 3 passes through the bypass pipe 4*d* and the second refrigerant flow switching device 18*b*(2), and flows into the heat exchanger related to heat medium 15*b*, functioning as a condenser.

The two-phase refrigerant that has flowed into the heat exchanger related to heat medium 15*b* is condensed and liquefied while transferring heat to the heat medium circulating in the heat medium cycle B, and turns into a liquid refrigerant. The liquid refrigerant flowing out of the heat exchanger related to heat medium 15*b* is expanded into a low-pressure two-phase refrigerant by the expansion device 16*b*. This low-pressure two-phase refrigerant flows through the expansion device 16*a* into the heat exchanger related to heat medium 15*a*, functioning as an evaporator. The low-pressure two-phase refrigerant flowing into the heat exchanger related to heat medium 15*a* removes heat from the heat medium circulating in the heat medium cycle B to cool the heat medium, and thus turns into a low-pressure gas refrigerant. This gas refrigerant flows out of the heat exchanger related to heat medium 15*a*, flows through the second refrigerant flow switching device 18*a*(1) and out of the heat medium relay unit 3, passes through the refrigerant pipe 4, and again flows into the outdoor unit 1. The refrigerant flowing into the outdoor unit 1 passes through the first refrigerant flow switching device 11 and the accumulator 19, and is again sucked into the compressor 10.

At that time, the second refrigerant flow switching device 18*a*(1) is opened, the second refrigerant flow switching device 18*a*(2) is closed, the second refrigerant flow switching device 18*b*(1) is closed, and the second refrigerant flow switching device 18*b*(2) is opened. Because the second refrigerant flow switching device 18*a*(2) is closed and the second refrigerant flow switching device 18*b*(2) is opened, the high-pressure liquid refrigerant flows through the bypass pipe 4*d*, and the bypass pipe 4*d* is filled with the high-pressure refrigerant.

The opening degree of the expansion device 16*b* is controlled such that superheat is constant, the superheat being obtained as the difference between a temperature detected by the third temperature sensor 35*a* and that detected by the third temperature sensor 35*b*. The expansion device 16*a* is fully opened, and the on-off device 17 is closed. In addition, the opening degree of the expansion device 16*b* may be controlled such that subcooling is constant, the subcooling being obtained as the difference between a value indicating a saturation temperature calculated from a pressure detected by the pressure sensor 36 and a temperature detected by the third temperature sensor 35*d*. Alternatively, the expansion device 16*b* may be fully opened, and the superheat or subcooling may be controlled using the expansion device 16*a*.

Next, the flow of the heat medium in the heat medium cycle B will be described.

In the cooling main operation mode, the heat exchanger related to heat medium 15*b* transfers heating energy of the heat source side refrigerant to the heat medium, and the pump 21*b* allows the heated heat medium to flow through the pipes 5. Furthermore, in the cooling main operation mode, the heat exchanger related to heat medium 15*a* transfers cooling energy of the heat source side refrigerant to the heat medium, and the pump 21*a* allows the cooled heat medium to flow through the pipes 5. The heat medium, which has flowed out of the pump 21*a* and the pump 21*b* while being pressurized, flows through the second heat medium flow switching device 23*a* and the second heat medium flow switching device 23*b* into the use side heat exchanger 26*a* and the use side heat exchanger 26*b*.

In the use side heat exchanger 26*b*, the heat medium transfers heat to the indoor air, thus heating the indoor space 7. In addition, in the use side heat exchanger 26*a*, the heat medium removes heat from the indoor air, thus cooling the indoor space 7. At this time, the function of each of the heat medium flow control device 25*a* and the heat medium flow control device 25*b* allows the heat medium to flow into the corresponding one of the use side heat exchanger 26*a* and the use side heat exchanger 26*b* while controlling the heat medium to a flow rate sufficient to cover an air conditioning load required in the indoor space. The heat medium, which has passed through the use side heat exchanger 26*b* with a slight decrease of temperature, passes through the heat medium flow controller 25*b* and the first heat medium flow switching device 22*b*, flows into the heat exchanger related to heat medium 15*b*, and is again sucked into the pump 21*b*. The heat medium, which has passed through the use side heat exchanger 26*a* with a slight increase of temperature, passes through the heat medium flow controller 25*a* and the first heat medium flow switching device 22*a*, flows into the heat exchanger related to heat medium 15*a*, and is then again sucked into the pump 21*a*.

During this time, the function of the first heat medium flow switching devices 22 and the second heat medium flow switching devices 23 allow the heated heat medium and the cooled heat medium to be introduced into the respective use side heat exchangers 26 having a heating energy load and a cooling energy load, without being mixed. Note that in the pipe 5 in each of the use side heat exchanger 26 for heating and that for cooling, the heat medium is directed to flow from the second heat medium flow switching device 23 through the heat medium flow controller 25 to the first heat medium flow switching device 22. Furthermore, the difference between the temperature detected by the first temperature sensor 31*b* and that detected by the second temperature sensor 34 is controlled such that the difference is kept at a target value, so that the heating air conditioning load required in the indoor space 7 can be covered. The difference between the temperature detected by the second temperature sensor 34 and that detected by the first temperature sensor 31*a* is controlled such that the difference is kept at a target value, so that the cooling air conditioning load required in the indoor space 7 can be covered.

Upon carrying out the cooling main operation mode, since it is unnecessary to supply the heat medium to each use side heat exchanger 26 having no heat load (including thermo-off), the passage is closed by the corresponding heat medium flow controller 25 such that the heat medium does not flow into the use side heat exchanger 26. In FIG. 5, the heat medium is supplied to the use side heat exchanger 26*a* and the use side heat exchanger 26*b* because these use side heat exchangers have heat loads. The use side heat exchanger 26*c* and the use side heat exchanger 26*d* have no heat load and the corresponding heat medium flow controllers 25*c* and 25*d* are fully closed. When a heat load is generated in the use side heat exchanger 26*c* or the use side heat exchanger 26*d*, the heat medium flow controller 25*c* or the heat medium flow controller 25*d* may be opened such that the heat medium is circulated.

[Heating Main Operation Mode]

Figure 6:
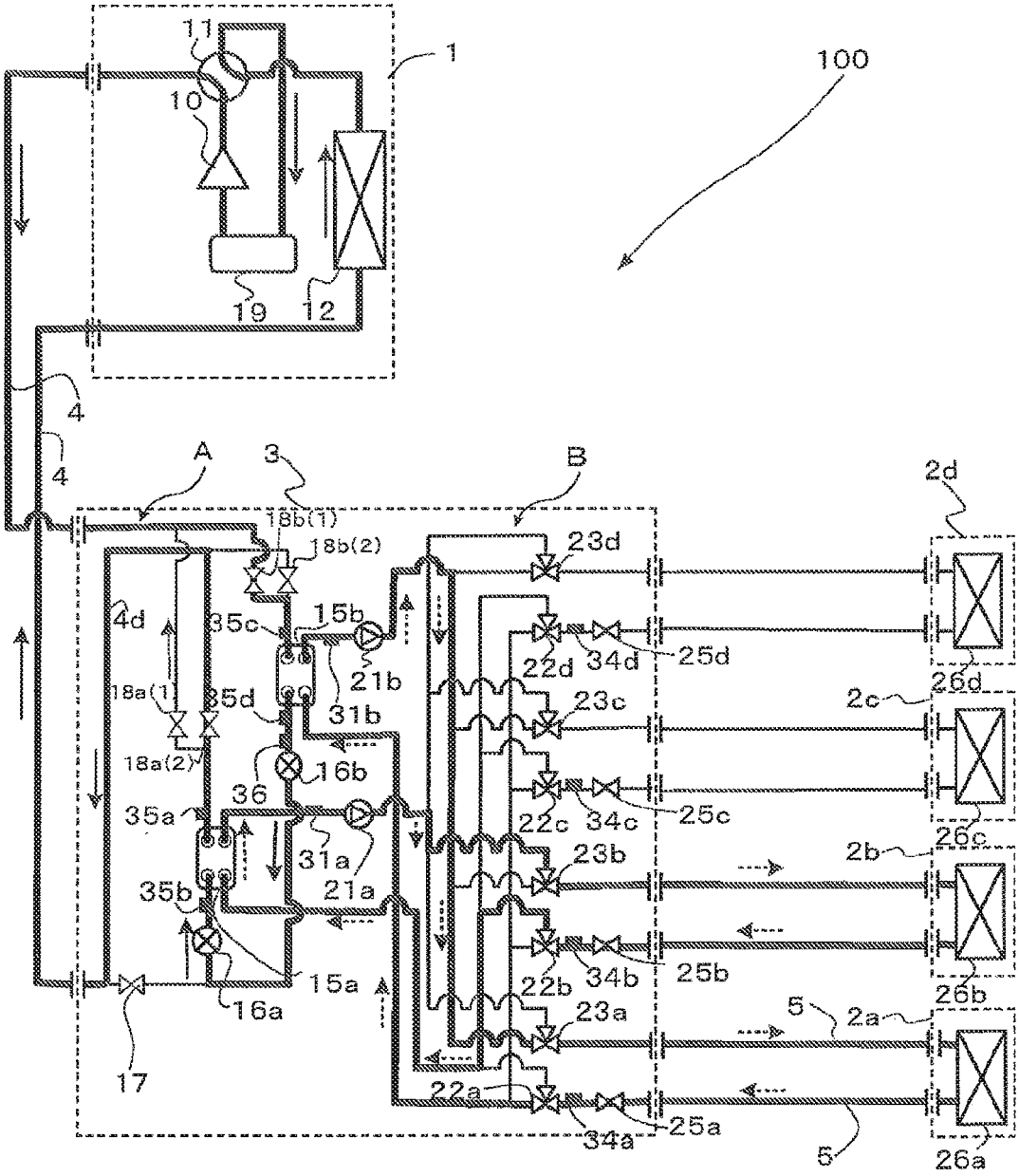
FIG. 6 is a refrigerant circuit diagram illustrating flows of the refrigerants in a heating main operation mode of the air-conditioning apparatus according to Embodiment of the invention.

FIG. 6 is a refrigerant circuit diagram illustrating the flows of the refrigerants in the heating main operation mode of the air-conditioning apparatus 100. The heating main operation mode will be described with respect to a case in which a heating energy load is generated in the use side heat exchanger 26*a* and a cooling energy load is generated in the use side heat exchanger 26*b* in FIG. 6. Furthermore, in FIG. 6, pipes indicated by thick lines correspond to pipes through which the refrigerants (the heat source side refrigerant and the heat medium) circulate. In addition, the direction of flow of the heat source side refrigerant is indicated by solid-line arrows and the direction of flow of the heat medium is indicated by broken-line arrows in FIG. 6.

In the heating main operation mode illustrated in FIG. 6, in the outdoor unit 1, the first refrigerant flow switching device 11 is switched such that the heat source side refrigerant discharged from the compressor 10 flows into the heat medium relay unit 3 without passing through the heat source side heat exchanger 12. In the heat medium relay unit 3, the on-off device is closed, the pump 21*a* and the pump 21*b* are driven, the heat medium flow controller 25*a* and the heat medium flow controller 25*b* are opened, and the heat medium flow controller 25*c* and the heat medium flow controller 25*d* are fully closed such that the heat medium circulates between the heat exchanger related to heat medium 15*a* and the use side heat exchanger 26*b* and the heat medium circulates between the heat exchanger related to heat medium 15*b* and the use side heat exchanger 26*a*.

First, the flow of the heat source side refrigerant in the refrigerant cycle A will be described.

A low-temperature low-pressure refrigerant is compressed by the compressor 10 and is discharged as a high-temperature high-pressure gas refrigerant therefrom. The high-temperature high-pressure gas refrigerant discharged from the compressor 10 passes through the first refrigerant flow switching device 11 and flows out of the outdoor unit 1. The high-temperature high-pressure gas refrigerant, which has flowed out of the outdoor unit 1, passes through the refrigerant pipe 4 and flows into the heat medium relay unit 3. The high-temperature high-pressure gas refrigerant flowing into the heat medium relay unit 3 passes through the second refrigerant flow switching device 18*b*(1) and flows into the heat exchanger related to heat medium 15*b*, functioning as a condenser.

The gas refrigerant flowing into the heat exchanger related to heat medium 15*b* is condensed into a liquid refrigerant while transferring heat to the heat medium circulating in the heat medium cycle B. The liquid refrigerant flowing out of the heat exchanger related to heat medium 15*b* is expanded into a low-pressure two-phase refrigerant by the expansion device 16*b*. This low-pressure two-phase refrigerant flows through the expansion device 16*a* into the heat exchanger related to heat medium 15*a*, functioning as an evaporator. The low-pressure two-phase refrigerant flowing into the heat exchanger related to heat medium 15*a* removes heat from the heat medium circulating in the heat medium cycle B to evaporate, thus cooling the heat medium. This low-pressure two-phase refrigerant flows out of the heat exchanger related to heat medium 15*a*, passes through the second refrigerant flow switching device 18*a*(2) and the bypass pipe 4*d*, flows out of the heat medium relay unit 3, passes through the refrigerant pipe 4, and again flows into the outdoor unit 1.

At that time, the second refrigerant flow switching device 18*a*(1) is closed, the second refrigerant flow switching device 18*a*(2) is opened, the second refrigerant flow switching device 18*b*(1) is opened, and the second refrigerant flow switching device 18*b*(2) is closed. Because the second refrigerant flow switching device 18*a*(2) is opened and the second refrigerant flow switching device 18*b*(2) is closed, the low-pressure two-phase refrigerant flows in the bypass pipe 4*d*, and the bypass pipe 4*d* is filled with the low-pressure refrigerant.

The refrigerant flowing into the outdoor unit 1 flows into the heat source side heat exchanger 12, functioning as an evaporator. Then, the refrigerant flowing into the heat source side heat exchanger 12 removes heat from the outdoor air in the heat source side heat exchanger 12 and thus turns into a low-temperature low-pressure gas refrigerant. The low-temperature low-pressure gas refrigerant flowing out of the heat source side heat exchanger 12 passes through the first refrigerant flow switching device 11 and the accumulator 19 and is again sucked into the compressor 10.

At this time, the opening degree of the expansion device 16*b* is controlled such that subcooling is constant, the subcooling being obtained as the difference between a value indicating a saturation temperature calculated from a pressure detected by the pressure sensor 36 and a temperature detected by the third temperature sensor 35*b*. The expansion device 16*a* is fully opened, and the on-off device 17 is closed. Alternatively, the expansion device 16*b* may be fully opened, and the subcooling may be controlled using the expansion device 16*a*.

Next, the flow of the heat medium in the heat medium cycle B will be described.

In the heating main operation mode, the heat exchanger related to heat medium 15*b* transfers heating energy of the heat source side refrigerant to the heat medium, and the pump 21*b* allows the heated heat medium to flow through the pipes 5. Furthermore, in the heating main operation mode, the heat exchanger related to heat medium 15*a* transfers cooling energy of the heat source side refrigerant to the heat medium, and the pump 21*a* allows the cooled heat medium to flow through the pipes 5. The heat medium, which has flowed out of the pump 21*a* and the pump 21*b* while being pressurized, flows through the second heat medium flow switching device 23*a* and the second heat medium flow switching device 23*b* into the use side heat exchanger 26*a* and the use side heat exchanger 26*b*.

In the use side heat exchanger 26*b*, the heat medium removes heat from the indoor air, thus cooling the indoor space 7. In addition, in the use side heat exchanger 26*a*, the heat medium transfers heat to the indoor air, thus heating the indoor space 7. At this time, the function of each of the heat medium flow control device 25*a* and the heat medium flow control device 25*b* allows the heat medium to flow into the corresponding one of the use side heat exchanger 26*a* and the use side heat exchanger 26*b* while controlling the heat medium to a flow rate sufficient to cover an air conditioning load required in the indoor space. The heat medium, which has passed through the use side heat exchanger 26*b* with a slight increase of temperature, passes through the heat medium flow controller 25*b* and the first heat medium flow switching device 22*b*, flows into the heat exchanger related to heat medium 15*a*, and is then again sucked into the pump 21*a*. The heat medium, which has passed through the use side heat exchanger 26*a* with a slight decrease of temperature, passes through the heat medium flow controller 25*a* and the first heat medium flow switching device 22*a*, flows into the heat exchanger related to heat medium 15*b*, and is again sucked into the pump 21*a*.

During this time, the function of the first heat medium flow switching devices 22 and the second heat medium flow switching devices 23 allow the heated heat medium and the cooled heat medium to be introduced into the respective use side heat exchangers 26 having a heating energy load and a cooling energy load, without being mixed. Note that in the pipe 5 in each of the use side heat exchanger 26 for heating and that for cooling, the heat medium is directed to flow from the second heat medium flow switching device 23 through the heat medium flow controller 25 to the first heat medium flow switching device 22. Furthermore, the difference between the temperature detected by the first temperature sensor 31*b* and that detected by the second temperature sensor 34 is controlled such that the difference is kept at a target value, so that the heating air conditioning load required in the indoor space 7 can be covered. The difference between the temperature detected by the second temperature sensor 34 and that detected by the first temperature sensor 31*a* is controlled such that the difference is kept at a target value, so that the cooling air conditioning load required in the indoor space 7 can be covered.

Upon carrying out the heating main operation mode, since it is unnecessary to supply the heat medium to each use side heat exchanger 26 having no heat load (including thermo-off), the passage is closed by the corresponding heat medium flow controller 25 such that the heat medium does not flow into the use side heat exchanger 26. In FIG. 6, the heat medium is supplied to the use side heat exchanger 26*a* and the use side heat exchanger 26*b* because these use side heat exchangers have a heat loads. The use side heat exchanger 26*c* and the use side heat exchanger 26*d* have no heat load and the corresponding heat medium flow controllers 25*c* and 25*d* are fully closed. When a heat load is generated in the use side heat exchanger 26*c* or the use side heat exchanger 26*d*, the heat medium flow controller 25*c* or the heat medium flow controller 25*d* may be opened such that the heat medium is circulated.

As described above, in the air-conditioning apparatus 100 according to Embodiment, the pressure of the bypass pipe 4*d* varies depending on the switching state of the first refrigerant flow switching device 11, and, accordingly, the bypass pipe 4*d* is filled with either a high-pressure refrigerant or a low-pressure refrigerant.

In the cooling main operation mode or the heating main operation mode, when the states (heating or cooling) of the heat exchanger related to heat medium 15*b* and the heat exchanger related to heat medium 15*a* change, the water that has been hot are cooled turning into cold water, and the water that has been cold are heated turning into hot water. And thus, energy is wasted. To address this, in both the cooling main operation mode and the heating main operation mode, the heat exchanger related to heat medium 15*b* is configured to always be on the heating side, and the heat exchanger related to heat medium 15*a* is configured to always be on the cooling side.

[State from System Stop to System Start]

When in a state in which the system is stopped and the compressor 10 is stopped, it is unclear which operation mode will be started next among the cooling only operation mode, heating only operation mode, cooling main operation mode, and heating main operation mode.

In the air-conditioning apparatus 100, the members of the second refrigerant flow switching device 18 are in the same switching state in both the cooling only operation mode (FIG. 3) and the heating only operation mode (FIG. 4). In contrast, in the air-conditioning apparatus 100, the members of the second refrigerant flow switching device 18 are in opposite switching states in both the cooling main operation mode (FIG. 5) and the heating main operation mode (FIG. 6). Thus, when the system of the air-conditioning apparatus 100 is stopped, the second refrigerant flow switching device 18 may be set in the same state as that in the cooling only operation mode or heating only operation mode. With this setting, at a system startup of the air-conditioning apparatus 100, an operation starts in the cooling only operation mode or heating only operation mode in response to the switching state of the first refrigerant flow switching device 11, and the heat source side refrigerant starts circulating.

In the case of the cooling main operation mode or heating main operation mode, subsequently, the state of the second refrigerant flow switching device 18*a* may be switched. With the above, the system can start reliably, and thus, pressure change in the refrigeration cycle becomes fast and the system startup can be achieved promptly. In the case of the cooling only operation mode or heating only operation mode, it is not necessary to switch the second refrigerant flow switching device 18. As a result, compared to other states, the probability of the need to switch the second refrigerant flow switching device 18 at startup will decrease, and thus the switching noise of the second refrigerant flow switching device 18 will lessen and a system with less sound can be configured.

[Refrigerant Pipe 4]

As described above, the air-conditioning apparatus 100 according to Embodiment has several operation modes. In these operation modes, the heat source side refrigerant flows through the refrigerant pipes 4 connecting the outdoor unit 1 and the heat medium relay unit 3.

[Pipe 5]

In some operation modes carried out by the air-conditioning apparatus 100 according to Embodiment, the heat medium, such as water or antifreeze, flows through the pipes 5 connecting the heat medium relay unit 3 and the indoor units 2.

In the air-conditioning apparatus 100, in the case in which only the heating load or cooling load is generated in the use side heat exchangers 26, the corresponding first heat medium flow switching devices 22 and the corresponding second heat medium flow switching devices 23 are controlled so as to have a medium opening degree, such that the heat medium flows into both of the heat exchanger related to heat medium 15*a* and the heat exchanger related to heat medium 15*b*. Consequently, since both of the heat exchanger related to heat medium 15*a* and the heat exchanger related to heat medium 15*b* can be used for the heating operation or the cooling operation, the heat transfer area can be increased, and accordingly the heating operation or the cooling operation can be efficiently performed.

In addition, in the case in which the heating load and the cooling load simultaneously occur in the use side heat exchangers 26, the first heat medium flow switching device 22 and the second heat medium flow switching device 23 corresponding to the use side heat exchanger 26 which performs the heating operation are switched to the passage connected to the heat exchanger related to heat medium 15*b* for heating, and the first heat medium flow switching device 22 and the second heat medium flow switching device 23 corresponding to the use side heat exchanger 26 which performs the cooling operation are switched to the passage connected to the heat exchanger related to heat medium 15*a* for cooling, so that the heating operation or cooling operation can be freely performed in each indoor unit 2.

Furthermore, each of the first heat medium flow switching devices 22 and the second heat medium flow switching devices 23 described in Embodiment may be any of the sort as long as it can switch passages, for example, a three-way valve capable of switching between three passages or a combination of two on-off valves and the like switching between two passages. Alternatively, a device capable of changing the flow rates in a three-way passage, such as a stepper motor driven mixing valve, or a combination of two devices each capable of changing the flow rate in a two-way passage, such as an electronic expansion valve, may be used as each of the first heat medium flow switching device 22 and the second heat medium flow switching device 23. In this case, water hammer caused by abrupt opening and closing of a passage can be prevented. Furthermore, while Embodiment has been described with respect to the case in which the heat medium flow control devices 25 each include a two-way valve, each of the heat medium flow control devices 25 may include a control valve having three passages and the valve may be disposed with a bypass pipe that bypasses the corresponding use side heat exchanger 26.

Furthermore, as regards each of the use side heat medium flow control device 25, a stepper-motor-driven type that is capable of controlling a flow rate in a passage may be used. Alternatively, a two-way valve or a three-way valve whose one end is closed may be used. A device that opens and closes a two-way passage, such as an on-off valve, may be used as the use side heat medium flow control device 25 and an average flow rate may be controlled by repeating on and off states.

While the air-conditioning apparatus 100 according to Embodiment has been described with respect to the case in which the apparatus can perform the cooling and heating mixed operation, but the apparatus is not limited to the case. For example, even in an apparatus that is configured by a single heat exchanger related to heat medium 15 and a single expansion device 16 that are connected to a plurality of parallel use side heat exchangers 26 and heat medium flow control valves 25, and is capable of carrying out only a cooling operation or a heating operation, the same advantages can obtained.

In addition, it is needless to say that the same holds true for the case in which a single use side heat exchanger 26 and a single heat medium flow control valves 25 are connected. Moreover, obviously, no problem will arise even if the heat exchanger related to heat medium 15 and the expansion device 16 acting in the same manner are arranged in plural numbers. Furthermore, while the case in which the heat medium flow control valves 25 are arranged in the heat medium relay unit 3 has been described, the arrangement is not limited to this case. Each heat medium flow control valves 25 may be disposed in the indoor unit 2. The heat medium relay unit 3 may be separated from the indoor unit 2.

As regards the heat source side refrigerant, a single refrigerant, such as R-22 or R-134a, a near-azeotropic refrigerant mixture, such as R-410A or R-404A, a non-azeotropic refrigerant mixture, such as R-407C, a refrigerant, such as $CF_3CF{=}CH_2$, containing a double bond in its chemical formula and having a relatively low global warming potential, a mixture containing the refrigerant, or a natural refrigerant, such as $CO_2$ or propane, can be used. While the heat exchanger related to heat medium 15*a* or the heat exchanger related to heat medium 15*b* is operating for heating, a refrigerant that typically changes between two phases is condensed and liquefied and a refrigerant that turns into a supercritical state, such as $CO_2$, is cooled in the supercritical state. As for the rest, either of the refrigerant acts in the same manner and offers the same advantages.

As regards the heat medium, for example, brine (antifreeze), water, a mixed solution of brine and water, or a mixed solution of water and an additive with high anticorrosive effect can be used. In the air-conditioning apparatus 100, therefore, even if the heat medium leaks into the indoor space 7 through the indoor unit 2, because the heat medium used is highly safe, contribution to improvement of safety can be made.

While Embodiment has been described with respect to the case in which the air-conditioning apparatus 100 includes the accumulator 19, the accumulator 19 may be omitted. Typically, a heat source side heat exchanger 12 and a use side heat exchanger 26 are provided with a blower and a current of air often facilitates condensation or evaporation. The structure is not limited to this case. For example, a heat exchanger, such as a panel heater, using radiation can be used as the use side heat exchanger 26 and a water-cooled heat exchanger which transfers heat using water or antifreeze can be used as the heat source side heat exchanger 12. In other words, as long as the heat exchanger is configured to be capable of transferring heat or removing heat, any type of heat exchanger can be used as each of the heat source side heat exchanger 12 and the use side heat exchanger 26.

While Embodiment has been described with respect to the case in which the number of use side heat exchangers 26 is four, the number of the use side heat exchangers is not especially limited. In addition, while Embodiment has been described with respect to the case in which two heat exchangers related to heat medium are arranged, namely, heat exchanger related to heat medium 15*a* and the heat exchanger related to heat medium 15*b*, it goes without saying that the arrangement is not limited to this case. As long as the heat exchanger related to heat medium 15 is configured to be capable of cooling or/and heating the heat medium, the number of heat exchangers related to heat medium 15 arranged is not limited. Furthermore, as regards each of the pump 21*a* and the pump 21*b*, the number of pumps is not limited to one. A plurality of pumps having a small capacity may be connected in parallel.

[Flow Directions of Heat Source Side Refrigerant and Heat Medium in Heat Exchanger Related to Heat Medium 15]

Figure 7:
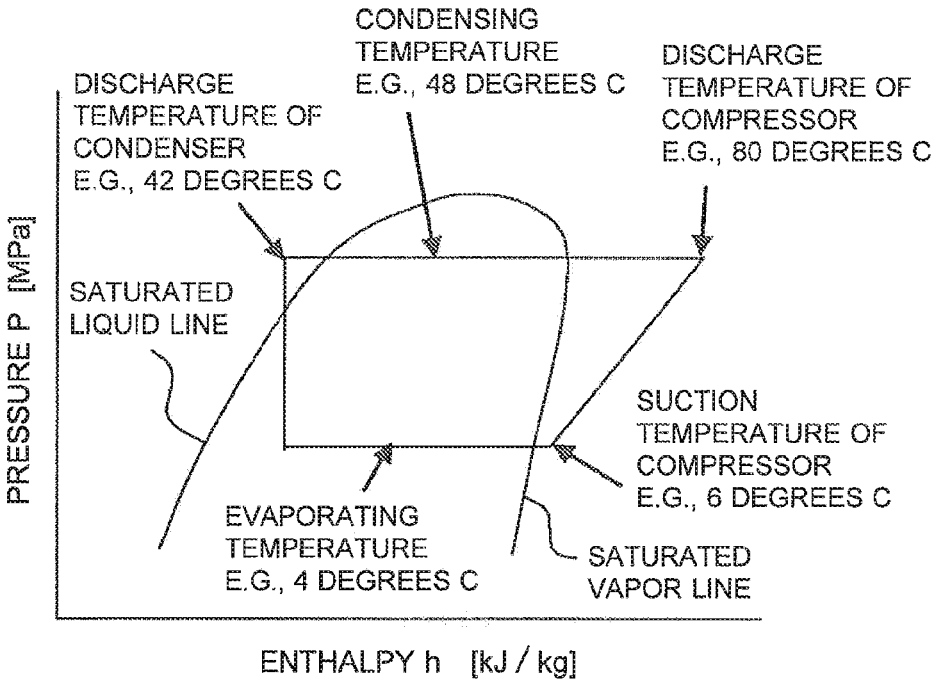
FIG. 7 show schematic P-h diagrams illustrating an operation of an air-conditioning apparatus according to Embodiment of the invention.
Figure 7:
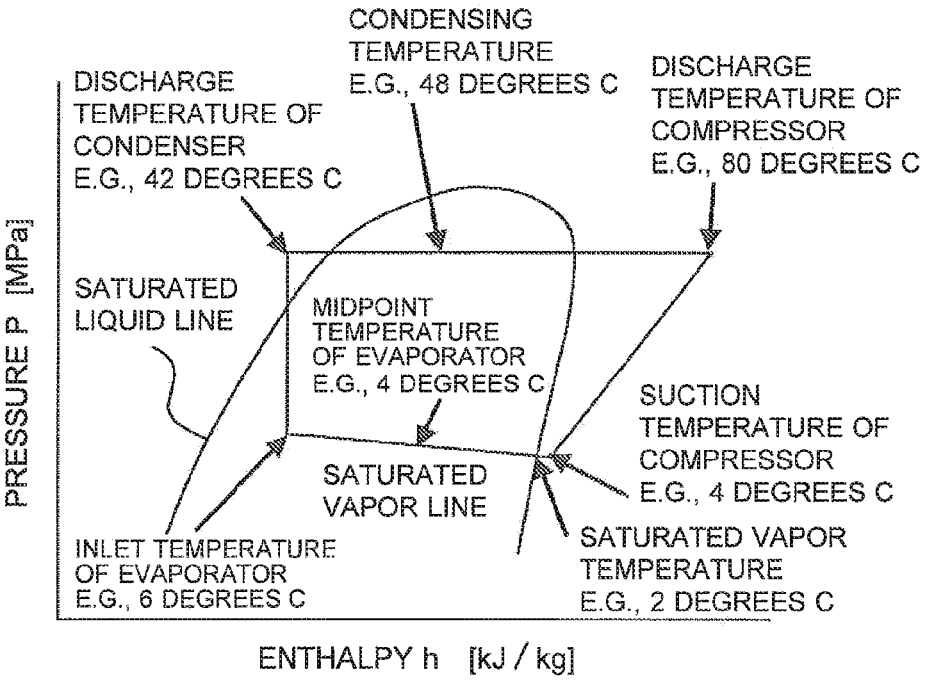

FIG. 7 illustrates P-h diagrams (pressure-enthalpy diagrams) that show operation of a refrigeration cycle of the air-conditioning apparatus 100 according to Embodiment of the present invention. Flow directions of the heat source side refrigerant and the heat medium in the heat exchanger related to heat medium 15 will be described with reference to FIG. 7. FIG. 7(*a*) illustrates a case in which no consideration of pressure loss in the heat exchanger related to heat medium 15 operating as an evaporator is made; FIG. 7(*b*) illustrates the case in which consideration of pressure loss in the heat exchanger related to heat medium 15 operating as an evaporator is made.

In the P-h diagram of FIG. 7(*a*), the high-temperature and high-pressure heat source side refrigerant flowing out of the compressor 10 enters the condenser (heat source side heat exchanger 12 or heat exchanger related to heat medium 15), is cooled, crosses the saturated vapor line, and enters a two-phase region. Then, the two-phase refrigerant gradually increases its proportion of liquid refrigerant, crosses the saturated liquid line, and turns into a liquid refrigerant. The liquid refrigerant is further cooled, exits the condenser, is expanded by the expansion device 16, is turned into a low-temperature and low-pressure two-phase refrigerant, flows into the evaporator (heat source side heat exchanger 12 or heat exchanger related to heat medium 15), and is heated. Then, the two-phase refrigerant gradually increases its proportion of gas, crosses the saturated vapor line, and turns into a gas refrigerant. The gas refrigerant is further heated, exits the evaporator, and is sucked into the compressor 10 again.

Here, the temperature of the refrigerant at the outlet of the compressor 10 is 80 degrees C., for example, the temperature of the heat source side refrigerant in the condenser in the two-phase state (condensing temperature) is 48 degrees C., for example, the temperature at the outlet of the condenser is 42 degrees C., for example, the temperature of the heat source side refrigerant in the evaporator in the two-phase state (evaporating temperature) is 4 degrees C., for example, and the suction temperature of the compressor 10 is 6 degrees C., for example.

The case in which the heat exchanger related to heat medium 15 operates as a condenser is discussed; it is assumed that the temperature of the heat medium flowing into the heat exchanger related to heat medium 15 is 40 degrees C., and the heat medium is heated by the heat exchanger related to heat medium 15 up to 50 degrees C. In this case, when the heat medium is made to flow in the opposite direction to the flow of the heat source refrigerant, the heat medium flowing into the heat exchanger related to heat medium 15 of 40 degrees C. is first heated by a subcooled refrigerant of 42 degrees C., slightly increases its temperature, is then further heated by a condensed refrigerant of 48 degrees C., is lastly heated by a superheated gas refrigerant of 80 degrees C., increases its temperature up to 50 degrees C., which is higher than the condensing temperature, and flows out of the heat exchanger related to heat medium 15. The subcooling temperature of the heat source side refrigerant at this time is 6 degrees C.

However, when the heat medium is made to flow in the same direction to the flow of the heat medium, the heat medium flowing into the heat exchanger related to heat medium 15 of 40 degrees C. is first heated by a superheated gas refrigerant of 80 degrees C., increases its temperature, and is then further heated by a condensed refrigerant of 48 degrees C. Therefore, the temperature of the heat medium flowing from the heat exchanger related to heat medium 15 does not exceed the condensing temperature. Therefore, the target temperature of 50 degrees C. is not reached, and the heating capability in the use side heat exchanger 26 is insufficient.

The refrigeration cycle with a certain degree of subcooling, for example, 5 degrees C. to 10 degrees C. increases efficiency (COP). However, because the temperature of the heat source side refrigerant does not fall below the temperature of the heat medium, even if the heat medium that has exchanged heat with the condensed refrigerant at 48 degrees C. in the heat exchanger related to heat medium 15 rises to 47 degrees C., for example, the refrigerant at the outlet of the heat exchanger related to heat medium 15 does not fall below 47 degrees C. The subcooling is, therefore, 1 degree C. or under, and the efficiency of the refrigeration cycle is reduced.

Therefore, when the heat exchanger related to heat medium 15 is used as a condenser, allowing the flows of the heat source side refrigerant and the heat medium to flow in opposite directions will increase the heating capacity along with increase of efficiency. Furthermore, the relationship between temperatures of the heat source side refrigerant and the heat medium is the same while using a heat source side refrigerant that does not change into two phases in the high-pressure side and that changes under a supercritical state, such as $CO_2$. In a gas cooler, which corresponds to a condenser for refrigerants that change into two phase, when the heat source side refrigerant is made to counter flow against the heat medium, heating capacity will increase along with the efficiency.

Next, the case in which the heat exchanger related to heat medium 15 operates as an evaporator is discussed. It is assumed that the temperature of the heat medium flowing into the heat exchanger related to heat medium 15 is 12 degrees C., and the heat medium is cooled by the heat exchanger related to heat medium 15 to 7 degrees C. In this case, when the heat medium flows in the opposite direction to the flow of the heat source side refrigerant, the heat medium flowing into the heat exchanger related to heat medium 15 at 12 degrees C. is first cooled by a superheated gas refrigerant of 6 degrees C. and is then cooled by an evaporating refrigerant of 4 degrees C., becomes 7 degrees C., and flows out of the heat exchanger related to heat medium 15. In contrast, when the heat medium flows in the same direction to the flow of the heat source side refrigerant, the heat medium flowing into the heat exchanger related to heat medium 15 at 12 degrees C. is cooled by an evaporating refrigerant of 4 degrees C. and reduces its temperature, is then cooled by a superheated gas of 6 degrees C., becomes 7 degrees C., and flows out of the heat exchanger related to heat medium 15.

When flowing in opposite directions, because there is a temperature difference of 3 degrees C. between the outlet temperature of the heat medium, which is 7 degrees C., and the outlet temperature of the refrigerant, which is 4 degrees C., the heat medium can be reliably cooled. As for when flowing in the same direction, because there is only a temperature difference of 1 degree C. between the heat medium at the outlet, which is 7 degrees C., and the refrigerant at the outlet, which is 6 degrees C., depending on the flow velocity of the heat medium, the outlet temperature of the heat medium may not be cooled to 7 degrees C. and the cooling capability may drop a certain amount. However, as regard the evaporator, the efficiency is better when there is substantially no superheat, and the superheat is controlled to approximately 0 to 2 degrees C. Accordingly, the difference of the cooling capacities are not so large between when flowing in opposite directions and when flowing in the same direction.

The pressure of the heat source side refrigerant in the evaporator is lower than that in the condenser, so the density is smaller and the pressure loss is more likely to occur. As illustrated in FIG. 7(*b*), assuming that the temperature of the heat source side refrigerant at midpoint of the evaporator is 4 degrees C., which is the same temperature as when there is no pressure loss, then, the temperature of the refrigerant at the inlet of the evaporator will be 6 degrees C., for example, the temperature of the refrigerant that becomes saturated gas in the evaporator will be 2 degrees C., for example, and the suction temperature of the compressor will be 4 degrees C., for example. In this state, when the heat medium flows in the opposite direction to the flow of the heat source side refrigerant, the heat medium flowing into the heat exchanger related to heat medium 15 at 12 degrees C. is first cooled by a superheated gas refrigerant of 4 degrees C., is then cooled by an evaporating refrigerant that changes its temperature from 2 degrees C. to 6 degrees C. by pressure loss, is lastly cooled by the heat source side refrigerant of 6 degrees C., becomes 7 degrees C., and flows out of the heat exchanger related to heat medium 15.

In contrast, when the heat medium flows in the same direction to the flow of the heat source side refrigerant, the heat medium flowing into the heat exchanger related to heat medium 15 at 12 degrees C. is cooled by an evaporating refrigerant of 6 degrees C., reduces its temperature, then further reduces its temperature in line with the refrigerant reducing its temperature from 6 degrees C. to 2 degrees C. by pressure loss. Ultimately, the heat source side refrigerant of 6 degrees C. and the heat medium of 7 degrees C. flow out of the heat exchanger related to heat medium 15.

In this state, the cooling efficiency is substantially the same when in the opposite flow directions and when in the same flow direction. In addition, if the pressure loss of the refrigerant in the evaporator further increases, the cooling efficiency may be improved if made to flow in the same direction.

Therefore, when the heat exchanger related to heat medium 15 is used as an evaporator, the heat source side refrigerant and the heat medium may flow in opposite directions or in the same direction. Considering that the flow is made to flow in opposite directions when the heat exchanger related to heat medium 15 is used as a condenser, when used as a evaporator, the flow will be opposite to the above and will be made to flow in the same direction; thus, the efficiency of the cooling and heating in total is increased as a total.

As described above, the air-conditioning apparatus according to Embodiment is capable of starting the system reliably and promptly, and, thus, achieving energy saving. The air-conditioning apparatus 100 is capable of increasing safety by not circulating the refrigerant near or in the indoor unit 2. In addition, the air-conditioning apparatus 100 can reduce the connection pipes (refrigerant pipes 4, pipes 5) between the outdoor unit 1 and the heat medium relay unit 3 or between the indoor unit 2 and the heat medium relay unit 3 and increase ease of construction.

REFERENCE SIGNS LIST

1 outdoor unit, 2 indoor unit, 2*a* indoor unit, 2*b* indoor unit, 2*c* indoor unit, 2*d* indoor unit, 3 heat medium relay unit, 3*a* main-heat medium relay unit, 3*b* sub-heat medium relay unit, 4 refrigerant pipe, 4*d* bypass pipe, 5 pipe, 6 outdoor space, 7 indoor space, 8 space, 9 structure, 10 compressor, 11 first refrigerant flow switching device, 12 heat source side heat exchanger, 14 gas-liquid separator, 15 heat exchanger related to heat medium, 15*a* heat exchanger related to heat medium, 15*b* heat exchanger related to heat medium, 16 expansion device, 16*a* expansion device, 16*b* expansion device, 16*c* expansion device, 17 on-off device, 17*b* on-off device, 18 second refrigerant flow switching device, 18A refrigerant flow switching device, 18B refrigerant flow switching device, 18*a*(1) second refrigerant flow switching device, 18*a*(2) second refrigerant flow switching device, 18*b*(1) second refrigerant flow switching device, 18*b*(2) second refrigerant flow switching device, 19 accumulator, 21 pump, 21*a* pump, 21*b* pump, 22 first heat medium flow switching device, 22*a* first heat medium flow switching device, 22*b* first heat medium flow switching device, 22*c* first heat medium flow switching device, 22*d* first heat medium flow switching device, 23 second heat medium flow switching device, 23*a* second heat medium flow switching device, 23*b* second heat med flow switching device, 23*c* second heat medium flow switching device, 23*d* second heat medium flow switching device, 25 heat medium flow control device, 25*a* heat medium flow control device, 25*b* heat medium flow control device, 25*c* heat medium flow control device, 25*d* heat medium flow control device, 26 use side heat exchanger, 26*a* use side heat exchanger, 26*b* use side heat exchanger, 26*c* use side heat exchanger, 26*d* use side heat exchanger, 31 first temperature sensor, 31*a* first temperature sensor, 31*b* first temperature sensor, 34 second temperature sensor, 34*a* second temperature sensor, 34*b* second temperature sensor, 34*c* second temperature sensor, 34*d* second temperature sensor, 35 third temperature sensor, 35*a* third temperature sensor, 35*b* third temperature sensor, 35*c* third temperature sensor, 35*d* third temperature sensor, 36 pressure sensor, 41 flow switching portion, 42 flow switching portion, 100 air-conditioning apparatus, 100A air-conditioning apparatus, A refrigerant cycle, B heat medium cycle

The invention claimed is:

1. An air-conditioning apparatus comprising:

an outdoor unit having a compressor, a first flow switching device, and a heat source side heat exchanger;

a heat medium relay unit having a plurality of heat medium heat exchangers, a plurality of expansion devices respectively correlated with the heat medium heat exchangers, and a plurality of pumps;

a plurality of use side heat exchangers;

a refrigerant cycle that includes the compressor, the first flow switching device, the heat source side heat exchanger, the expansion devices, and the plurality of heat medium heat exchangers, and wherein the compressor, the first flow switching device, the heat source side heat exchanger, the expansion devices, and the plurality of heat medium heat exchangers are connected by refrigerant pipes;

a heat medium cycle that includes the plurality of heat medium heat exchangers, the pumps, and the use side heat exchangers, wherein the plurality of heat medium heat exchangers each exchange heat between refrigerant in the refrigerant cycle and a heat transfer medium in the heat medium cycle, wherein the air-conditioning apparatus is configured to operate in a heating only operation mode in which the refrigerant in a high-temperature and high-pressure state flows into all of the plurality of heat medium heat exchangers, wherein the air-conditioning apparatus is configured to operate in a cooling only operation mode in which the refrigerant in a low-temperature and low-pressure state flows into all of the plurality of heat medium heat exchangers, and wherein the air-conditioning apparatus is configured to operate a cooling and heating mixed operation in which the refrigerant in the high-temperature and high-pressure state flows into one or some of the plurality of heat medium heat exchangers to heat the heat transfer medium and the refrigerant in the low-temperature and low-pressure state flows into one or some of the other heat medium heat exchangers to cool the heat transfer medium;

a bypass pipe that branches off from a portion of the refrigerant pipes between the heat source side heat exchanger and the plurality of heat medium heat exchangers, and the bypass pipe diverges into portions that respectively connect to each of the plurality of heat medium heat exchangers;

a plurality of second flow switching devices, each of which is respectively disposed on a refrigerant outlet side of each of the plurality of heat medium heat exchangers, switching a passage between a passage connecting to the outdoor unit and the bypass pipe;

a third flow switching device, which is disposed in a passage between the refrigerant inlet side of the plurality of heat medium heat exchangers and a branching part of the bypass pipe, is configured to cause opening and closing of the passage;

a control device configured to control the first flow switching device, the expansion devices, the plurality of second flow switching devices, and the third flow switching device; and at least one sensor configured to detect at least one of temperature and pressure information, and transmit the at least one of temperature and pressure information to the control device, wherein in response to a change in a switching state of the first flow switching device, the pressure state of the refrigerant in the bypass pipe is switched from a high pressure to a low pressure or from a low pressure to a high pressure, the refrigerant does not flow through the bypass pipe in the heating only operation mode and the cooling only operation mode, the refrigerant flows through the bypass pipe in the cooling and heating mixed operation, the control device is configured to control the cooling and heating mixed operation, and the cooling and heating mixed operation includes:

a cooling main operation mode in which, while the refrigerant in the high-temperature and high-pressure state flows into the heat source side heat exchanger, the refrigerant in the high-temperature and high-pressure state flows into at least one of the plurality of heat medium heat exchangers to heat the heat transfer medium and the refrigerant in the low-temperature and low-pressure state flows into at least one other heat medium heat exchanger to cool the heat transfer medium; and a heating main operation mode in which, while the refrigerant in low-temperature and low-pressure state flows into the heat source side heat exchanger, the refrigerant in the high-temperature and high-pressure state flows into at least one of the plurality of heat medium heat exchangers to heat the heat transfer medium and the refrigerant in the low-temperature and low-pressure state flows into at least one other heat medium heat exchanger to cool the heat transfer medium, the plurality of second flow switching devices are in the same switching state in both the cooling only operation mode and the heating only operation mode, wherein one or more of the plurality of second flow switching devices corresponding one-to-one to a corresponding one or more of the plurality of heat medium heat exchangers for cooling, and one or more of the remaining second flow switching devices corresponding one-to-one to a corresponding one or more of the remaining heat medium heat exchangers for heating are in opposite switching states for selecting the bypass pipe or the passage connecting to the outdoor unit in the cooling main operation mode and the heating main operation mode.

2. The air-conditioning apparatus of claim 1, wherein the plurality of heat medium heat exchangers functioning as evaporators for the refrigerant cycle in the cooling main operation mode also function as evaporators for the refrigerant cycle in the heating main operation mode, and the plurality of heat medium heat exchangers functioning as condensers for the refrigerant cycle in the cooling main operation mode also function as condensers for the refrigerant cycle in the heating main operation mode.

3. The air-conditioning apparatus of claim 1, wherein the control device is configured to open the third flow switching device in the cooling only operation mode and the heating only operation mode, and close the third flow switching device in the cooling and heating mixed operation.

4. The air-conditioning apparatus of claim 1, wherein the control device is configured to control the second flow switching devices so that when the compressor is stopped, switching states of the second flow switching devices are the same as the switching state of the cooling only operation mode and the heating only operation mode.

5. The air-conditioning apparatus of claim 1, wherein the control device is configured to control the first flow switching device, the second flow switching devices and the third flow switching device so that the plurality of heat medium heat exchangers flow the refrigerant and the heat transfer medium in opposite directions in the heating only operation mode and flow the refrigerant and the heat transfer medium in the same direction in the cooling only operation mode.

6. The air-conditioning apparatus of claim 1, wherein the outdoor unit and the heat medium relay unit are interconnected via two pipes.

* * * * *